US007018767B2

(12) United States Patent
Qian et al.

(10) Patent No.: US 7,018,767 B2
(45) **Date of Patent: *Mar. 28, 2006**

(54) GEL ORGANOSOL INCLUDING AMPHIPATHIC COPOLYMERIC BINDER HAVING ACID/BASE FUNCTIONALITY AND LIQUID TONERS FOR ELECTROPHOTOGRAPHIC APPLICATIONS

(75) Inventors: Julie Y. Qian, Woodbury, MN (US); James A. Baker, Hudson, WI (US)

(73) Assignee: Samsung Electronics Company, Suwon (KR)

( * ) Notice: Subject to any disclaimer, the term of this patent is extended or adjusted under 35 U.S.C. 154(b) by 206 days.

This patent is subject to a terminal disclaimer.

(21) Appl. No.: 10/612,058

(22) Filed: Jun. 30, 2003

(65) Prior Publication Data

US 2004/0265722 A1 Dec. 30, 2004

(51) Int. Cl.
*G03G 9/00* (2006.01)

(52) U.S. Cl. ..... 430/114; 430/117; 430/137.22

(58) Field of Classification Search ..... 430/114, 430/117, 137.22

See application file for complete search history.

(56) References Cited

U.S. PATENT DOCUMENTS

| | | | | |
|---|---|---|---|---|
| 5,384,226 | A | 1/1995 | Kanakura et al. | 430/137 |
| 5,650,253 | A | 7/1997 | Baker et al. | 430/119 |
| 5,652,282 | A | 7/1997 | Baker et al. | 523/201 |
| 5,698,616 | A | 12/1997 | Baker et al. | 523/201 |
| 5,843,613 | A | 12/1998 | Fujiwara et al. | 430/114 |
| 5,886,067 | A | 3/1999 | Li et al. | 523/201 |
| 5,916,718 | A | 6/1999 | Kellie et al. | 430/45 |
| 5,965,314 | A | 10/1999 | Herman et al. | 430/126 |
| 6,088,560 | A | 7/2000 | Zenk et al. | 399/237 |
| 6,103,781 | A | 8/2000 | Li et al. | 523/201 |
| 6,136,490 | A | 10/2000 | Ogawa et al. | 430/109 |
| 6,221,545 | B1 | 4/2001 | Tran et al. | 430/10 |
| 6,255,363 | B1 | 7/2001 | Baker et al. | 523/201 |
| 6,546,221 | B1 | 4/2003 | Baker et al. | 399/237 |
| 6,647,234 | B1 | 11/2003 | Herman et al. | 399/238 |
| 6,649,316 | B1 | 11/2003 | Baker et al. | 430/114 |
| 2002/0110390 | A1 | 8/2002 | Park et al. | 399/237 |
| 2003/0044202 | A1 | 3/2003 | Song et al. | 399/238 |
| 2003/0134940 | A1* | 7/2003 | Morrison et al. | 430/114 |

FOREIGN PATENT DOCUMENTS

| | | |
|---|---|---|
| EP | 0 852 746 B1 | 3/2000 |
| EP | 1327915 A1 | 7/2003 |
| JP | 05-119529 | 5/1993 |
| WO | WO 97/12285 A1 | 4/1997 |
| WO | WO 98/13731 A1 | 4/1998 |
| WO | WO 01/79316 A1 | 10/2001 |
| WO | WO 01/79363 A2 | 10/2001 |
| WO | WO 01/79364 A2 | 10/2001 |

OTHER PUBLICATIONS

U.S. Appl. No. 10/612,182, filed Jun. 30, 2003, entitled "Gel Organosol Including Amphipathic Copolymeric Binder Having Selected Molecular Weight and Liquid Toners for Electrophotographic Applications" (58 pgs.).

U.S. Appl. No. 10/612,448, filed Jun. 30, 2003, entitled "Gel Organosol Including Amphipathic Copolymeric Binder Having Hydrogen Bonding Functionality and Liquid Toners for Electrophotographic Applications" (74 pgs.).

U.S. Appl. No. 10/612,444, filed Jun. 30, 2003, entitled "Gel Organosol Including Amphipathic Copolymeric Binder Having Crosslinking Functionality and Liquid Toners for Electrophotographic Applications" (63 pgs.).

* cited by examiner

*Primary Examiner*—Mark A. Chapman
(74) *Attorney, Agent, or Firm*—Kagan Binder, PLLC

(57) ABSTRACT

The invention provides liquid toner compositions in which the polymeric binder is chemically grown in the form of copolymeric binder particles dispersed in a liquid carrier. The polymeric binder includes one amphipathic copolymer comprising one or more S material portions and one or more D material portions, wherein the components of the composition comprise sufficient acid and base functionality to provide a three dimensional gel of controlled rigidity which can be reversibly reduced to a fluid state by application of energy. The toners as described herein surprisingly provide compositions that are particularly suitable for electrophotographic processes wherein the transfer of the image from the surface of a photoconductor to an intermediate transfer material or directly to a print medium is carried out without film formation on the photoconductor.

26 Claims, No Drawings

GEL ORGANOSOL INCLUDING AMPHIPATHIC COPOLYMERIC BINDER HAVING ACID/BASE FUNCTIONALITY AND LIQUID TONERS FOR ELECTROPHOTOGRAPHIC APPLICATIONS

FIELD OF THE INVENTION

The present invention relates to liquid toner compositions having utility in electrophotography. More particularly, the invention relates to amphipathic copolymer binder particles provided in a gel composition.

BACKGROUND OF THE INVENTION

In electrophotographic and electrostatic printing processes (collectively electrographic processe), an electrostatic image is formed on the surface of a photoreceptive element or dielectric element, respectively. The photoreceptive element or dielectric element may be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227–252, and U.S. Pat. Nos. 4,728,983, 4,321,404, and 4,268,598.

In electrostatic printing, a latent image is typically formed by (1) placing a charge image onto a dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259.

In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process, discharged area development, involves a series of steps to produce an image on a receptor, including charging, exposure, development, transfer, fusing, cleaning, and erasure.

In the charging step, a photoreceptor is substantially uniformly covered with charge of a desired polarity to achieve a first potential, either negative or positive, typically with a corona or charging roller. In the exposure step, an optical system, typically a laser scanner or diode array, forms a latent image by selectively discharging the charged surface of the photoreceptor to achieve a second potential in an imagewise manner corresponding to the desired image to be formed on the final image receptor. In the development step, toner particles of the appropriate polarity are generally brought into contact with the latent image on the photoreceptor, typically using a developer electrically-biased to a potential of the same polarity as the toner polarity and intermediate in potential between the first and second potentials. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The image may be transferred by physical pressure and contact of the toner, with selective adhesion to a target intermediate or final image receptor as compared to the surface from which it is transferred. Alternatively, the toner may be transferred in a liquid system optionally using an electrostatic assist as discussed in more detail below. In the fusing step, the toned image on the final image receptor is heated to soften or melt the toner particles, thereby fusing the toned image to the final receptor. An alternative fusing method involves fixing the toner to the final receptor under pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from sub-micron to about 5 microns, liquid toners are capable of producing very high-resolution toned images.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

Polymeric binder materials suitable for use in liquid toner particles typically exhibit glass transition temperatures of about −24° C. to 55° C., which is lower than the range of glass transition temperatures (50–100° C.) typical for polymeric binders used in dry toner particles. In particular, some liquid toners are known to incorporate polymeric binders exhibiting glass transition temperatures ($T_g$) below room temperature (25° C.) in order to rapidly self fix, e.g. by film formation, in the liquid electrophotographic imaging process; see e.g. U.S. Pat. No. 6,255,363. However, such liquid toners are also known to exhibit inferior image durability resulting from the low $T_g$ (e.g. poor blocking and erasure resistance). In addition, such toners, while suitable for transfer processes involving contact adhesive forces, are generally unsuitable for transfer processes involving an electrostatic transfer assist due to the extreme tackiness of the toner films after fusing the toned image to a final image receptor. Also low $T_g$ toners are more sensitive to cohesive transfer failure (film split), and are more difficult to clean (sticky) from photoreceptors or intermediate transfer elements.

In other printing processes using liquid toners, self-fixing is not required. In such a system, the image developed on the photoconductive surface is transferred to an intermediate transfer belt ("ITB") or intermediate transfer member ("ITM") or directly to a print medium without film formation at this stage. See, for example, U.S. Pat. No. 5,410,392 to Landa, issued on Apr. 25, 1995; and U.S. Pat. No. 5,115,277 to Camis, issued on May 19, 1992. In such a system, this transfer of discrete toner particles in image form is carried out using a combination of mechanical forces, electrostatic forces, and thermal energy. In the system particularly described in the '277 patent, DC bias voltage is connected to an inner sleeve member to develop electrostatic forces at the surface of the print medium for assisting in the efficient transfer of color images.

The toner particles used in such a system have been previously prepared using conventional polymeric binder materials, and not polymers made using an organosol process (described in more detail below). Thus, for example the '392 patent states that the liquid developer to be used in the disclosed system is described in U.S. Pat. No. 4,794,651 to Landa, issued on Dec. 27, 1988. This patent discloses liquid toners made by heating a preformed high $T_g$ polymer resin in a carrier liquid to an elevated temperature sufficiently high for the carrier liquid to soften or plasticize the resin, adding a pigment, and exposing the resulting high temperature dispersion to a high energy mixing or milling process.

Although such non self-fixing liquid toners using higher $T_g$ ($T_g$ generally greater than or equal to about 60° C.) polymeric binders should have good image durability, such toners are known to exhibit other problems related to the choice of polymeric binder, including image defects due to the inability of the liquid toner to rapidly self fix in the imaging process, poor charging and charge stability, poor stability with respect to agglomeration or aggregation in storage, poor sedimentation stability in storage, and the requirement that high fusing temperatures of about 200–250° C. be used in order to soften or melt the toner particles and thereby adequately fuse the toner to the final image receptor.

To overcome the durability deficiencies, polymeric materials selected for use in both nonfilm-forming liquid toners and dry toners more typically exhibit a range of $T_g$ of at least about 55–65° C. in order to obtain good blocking resistance after fusing, yet typically require high fusing temperatures of about 200–250° C. in order to soften or melt the toner particles and thereby adequately fuse the toner to the final image receptor. High fusing temperatures are a disadvantage for dry toners because of the long warm-up time and higher energy consumption associated with high temperature fusing, and because of the risk of fire associated with fusing toner to paper at temperatures above the autoignition temperature of paper (233° C.).

In addition, some liquid and dry toners using high $T_g$ polymeric binders are known to exhibit undesirable partial transfer (offset) of the toned image from the final image receptor to the fuser surface at temperatures above or below the optimal fusing temperature, requiring the use of low surface energy materials in the fuser surface or the application of fuser oils to prevent offset. Alternatively, various lubricants or waxes have been physically blended into the dry toner particles during fabrication to act as release or slip agents; however, because these waxes are not chemically bonded to the polymeric binder, they may adversely affect triboelectric charging of the toner particle or may migrate from the toner particle and contaminate the photoreceptor, an intermediate transfer element, the fuser element, or other surfaces critical to the electrophotographic process.

In addition to the polymeric binder and the visual enhancement additive, liquid toner compositions can optionally include other additives. For example, charge control agents can be added to impart an electrostatic charge on the toner particles. Dispersing agents can be added to provide colloidal stability, aid fixing of the image, and provide charged or charging sites for the particle surface. Dispersing agents are commonly added to liquid toner compositions because toner particle concentrations are high (inter-particle distances are small) and electrical double-layer effects alone will not adequately stabilize the dispersion with respect to aggregation or agglomeration. Release agents can also be used to help prevent the toner from sticking to fuser rolls when those are used. Other additives include antioxidants, ultraviolet stabilizers, fungicides, bactericides, flow control agents, and the like.

One fabrication technique involves synthesizing an amphipathic copolymeric binder dispersed in a liquid carrier to form an organosol, then mixing the formed organosol with other ingredients to form a liquid toner composition. Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

Liquid toner compositions have been manufactured using dispersion polymerization in low polarity, low dielectric constant carrier solvents for use in making relatively low glass transition temperature ($T_g \leqq 30°$ C.) film-forming liquid toners that undergo rapid self-fixing in the electrophotographic imaging process. See, e.g., U.S. Pat. Nos. 5,886,067 and 6,103,781. Organosols have also been prepared for use in making intermediate glass transition temperature ($T_g$ between 30–55° C.) liquid electrostatic toners for use in electrostatic stylus printers. See, e.g., U.S. Pat. No. 6,255,363 B1. A representative non-aqueous dispersion polymerization method for forming an organosol is a free radical polymerization carried out when one or more ethylenically-unsaturated monomers, soluble in a hydrocarbon medium, are polymerized in the presence of a preformed, polymerizable solution polymer (e.g. a graft stabilizer or "living" polymer). See U.S. Pat. No. 6,255,363.

Once the organosol has been formed, one or more additives can be incorporated, as desired. For example, one or more visual enhancement additives and/or charge control agents can be incorporated. The composition can then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 1.0 microns) and may also partially shred the dispersed copolymeric binder into fragments that can associate with the surface of the visual enhancement additive.

According to this embodiment, the dispersed copolymer or fragments derived from the copolymer then associate with the visual enhancement additive, for example, by adsorbing to or adhering to the surface of the visual enhancement additive, thereby forming toner particles. The result is a sterically-stabilized, nonaqueous dispersion of toner particles having a size in the range of about 0.1 to 2.0 microns, with typical toner particle diameters in the range 0.1 to 0.5 microns. In some embodiments, one or more charge control agents can be added before or after mixing, if desired.

Several characteristics of liquid toner compositions are important to provide high quality images. Toner particle size and charge characteristics are especially important to form high quality images with good resolution. Further, rapid self-fixing of the toner particles is an important requirement for some liquid electrophotographic printing applications, e.g. to avoid printing defects (such as smearing or trailing-edge tailing) and incomplete transfer in high-speed printing. For example, in organosol toner compositions that exhibit low $T_g$s, the resulting film that is formed during the imaging process may be sticky and cohesively weak under transfer conditions. This may result in image splitting or undesired residue left on the photoreceptor or intermediate image receptor surfaces. Another important consideration in formulating a liquid toner composition relates to the durability and archivability of the image on the final receptor. Erasure resistance, e.g. resistance to removal or damage of the toned image by abrasion, particularly by abrasion from natural or synthetic rubber erasers commonly used to remove extraneous pencil or pen markings, is a desirable characteristic of liquid toner particles.

Another important consideration in formulating a liquid toner is the tack of the image on the final receptor. It is desirable for the image on the final receptor to be essentially tack-free over a fairly wide range of temperatures. If the image has a residual tack, then the image can become embossed or picked off when placed in contact with another surface (also referred to as blocking). This is particularly a problem when printed sheets are placed in a stack. Resistance of the image on the final image receptor to damage by blocking to the receptor (or to other toned surfaces) is another desirable characteristic of liquid toner particles.

To address this concern, a film laminate or protective layer may be placed over the surface of the image. This laminate often acts to increase the effective dot gain of the image, thereby interfering with the color rendition of a color composite. In addition, lamination of a protective layer over a final image surface adds both extra cost of materials and extra process steps to apply the protective layer, and may be unacceptable for certain printing applications (e.g. plain paper copying or printing).

Various methods have been used to address the drawbacks caused by lamination. For example, approaches have employed radiation or catalytic curing methods to cure or crosslink the liquid toner after the development step in order to eliminate tack. Such curing processes are generally too slow for use in high speed printing processes. In addition, such curing methods can add significantly to the expense of the printing process. The curable liquid toners frequently exhibit poor self stability and can result in brittleness of the printed ink.

Another method to improve the durability of liquid toned images and address the drawbacks of lamination is described in U.S. Pat. No. 6,103,781. U.S. Pat. No. 6,103,781 describes a liquid ink composition containing organosols having side-chain or main-chain crystallizable polymeric moieties. At column 6, lines 53–60, the authors describe a binder resin that is an amphipathic copolymer dispersed in a liquid carrier (also known as an organosol) that includes a high molecular weight (co)polymeric steric stabilizer covalently bonded to an insoluble, thermoplastic (co)polymeric core. The steric stabilizer includes a crystallizable polymeric moiety that is capable of independently and reversibly crystallizing at or above room temperature (22° C.).

According to the authors, superior stability of the dispersed toner particles with respect to aggregation is obtained when at least one of the polymers or copolymers (denoted as the stabilizer) is an amphipathic substance containing at least one oligomeric or polymeric component having a weight-average molecular weight of at least 5,000 which is solvated by the liquid carrier. In other words, the selected stabilizer, if present as an independent molecule, would have some finite solubility in the liquid carrier. Generally, this requirement is met if the absolute difference in Hildebrand solubility parameter between the steric stabilizer and the solvent is less than or equal to 3.0 $MPa^{1/2}$.

As described in U.S. Pat. No. 6,103,781, the composition of the insoluble resin core is preferentially manipulated such that the organosol exhibits an effective glass transition temperature ($T_g$) of less than 22° C., more preferably less than 6° C. Controlling the glass transition temperature allows one to formulate an ink composition containing the resin as a major component to undergo rapid film formation (rapid self-fixing) in liquid electrophotographic printing or imaging processes using offset transfer processes carried out at temperatures greater than the core $T_g$. Preferably, the offset transfer process is carried out at a temperature at or above 22° C. (Column 10, lines 36–46). The presence of the crystallizable polymeric moiety that is capable of independently and reversibly crystallizing at or above room temperature (22° C.) acts to protect the soft, tacky, low $T_g$ insoluble resin core after fusing to the final image receptor. This acts to improve the blocking and erasure resistance of the fused, toned image at temperatures up to the crystallization temperature (melting point) of the crystallizable polymeric moiety.

Liquid inks using gel organosol compositions have been described in U.S. Pat. No. 6,255,363, and also in WO 01/79316, WO 01/79363, and WO 01/79364. These systems are designed to provide toner compositions that will form films at room temperature and without specific drying procedures or heating elements. See, for example the U.S. Pat. No. '363 patent at column 15, lines 50–63. Thus, the $T_g$ of the toner materials described in these patents and applications specifically are described to be low as part of ability to form a film at room temperature.

SUMMARY OF THE INVENTION

The present invention relates to gel liquid electrophotographic toner compositions comprising a liquid carrier and toner particles dispersed in the liquid carrier. The liquid carrier has a Kauri-butanol number less than 30 mL. The toner particles comprise a polymeric binder comprising at least one amphipathic copolymer with one or more S material portions and one or more D material portions. The toner composition comprises acidic and basic functionality in an amount sufficient to provide a three dimensional gel of controlled rigidity which can be reversibly reduced to a fluid state by application of energy. The electrophotographic toner composition substantially does not form a film under Photoreceptor Image Formation conditions.

For purposes of the present invention, a "gel" is a three dimensional matrix of controlled rigidity which can be reversibly reduced to a fluid state by application of energy. Gel formation in particular is believed to result from particle-particle interactions that cause reversible agglomeration of the particles. These particle-particle interactions, however, are weak enough to be broken down by the application of shear energy, sonic energy, heat energy, and/or the like.

As noted above, the compositions of the present invention are formulated so that the toner substantially does not form a film under Photoreceptor Image Formation conditions, as defined below. Because of the unique formulation, essentially no film is formed on the photoconductor during the printing process. Instead, the image is transferred from the surface of a photoconductor to an intermediate transfer material or directly to a print medium without substantial film formation on the photoconductor. Film formation may occur after transfer from the photoconductor, preferably at or before the time of final fusing of the image on the final receptor.

"Photoreceptor Image Formation conditions" for purposes of the present invention means that a composition substantially does not form a film when at a solids content of from about 30% to about 40%, and at a temperature between 23° C. and 45° C., and more preferably does not form a film when at a solids content of less than 70% at a temperature between 23° C. and 45° C. As a primary consideration, the $T_g$ of the amphipathic polymer strongly influences whether a film is formed by the organosol gel composition of the present invention. Additional factors, however, may be brought to bear to influence the film formation properties of the composition, such as selection of carrier solvent, location of homogenous regions of polymer components having lower or higher $T_g$ as compared to the balance of the amphipathic copolymer, and the incorporation of various functional groups, particularly at the S material portion of the amphipathic copolymer. The skilled artisan is able to prepare organosol compositions meeting such identified film forming properties by manipulation of these and other factors that will be understood in the art.

Gel toner compositions that do not substantially form a film under Photoreceptor Image Formation conditions provide specific advantages, including excellent image transfer from the photoreceptor, with low or no back transfer of the image to the photoreceptor during the printing process. Additionally, the gel toner compositions exhibit exceptional storage stability without the need to incorporate dispersant, surfactant, or stabilizer additives in an amount deleterious to image quality, although these additional components can be used if desired. Because amphipathic copolymers are used, the S portion of the copolymer may easily comprise covalently bonded stabilizing functionalities that further assist in stabilization of the overall liquid toner composition. Superior final image properties are also observed relative to erasure resistance and blocking resistance.

Additionally, toner particles comprising the amphipathic copolymers as described herein are consistent in size and shape, and therefore provide substantial benefit in uniformity in image formation. Such uniformity of size and shape is difficult or impossible to achieve in conventionally milled toner binder polymers. The liquid toner compositions according to the invention provide a system wherein an image can surprisingly be provided having excellent image transfer, and additionally are resistant to blocking. Images made using the compositions of the present invention are surprisingly non-tacky and are resistant to marring and undesired erasure. The gels impart useful properties to the liquid ink, notably improved sedimentation stability of the colorant, without compromising print quality or ink transfer performance. The inks formulated with the gels also exhibit improved redispersion characteristics upon settling, and do not form dilatant sediments such as those formed by non-gelled organosol inks. These characteristics of gel inks facilitate preparation and use of high solids ink concentrates (greater than 2% by weight solids, more preferably greater than 10% by weight solids, and most preferably >20%), thus providing an increased number of printed pages or images from a given volume of ink. Surprisingly, the organosols of the present invention exhibit effectively larger particle size of gels, thereby exhibiting low to intermediate charge per mass (Q/M) suitable for high optical density development, but additionally exhibiting a break up of the gel under image development field to yield fine particles for high resolution imaging.

As used herein, the term "amphipathic" refers to a copolymer having a combination of portions having distinct solubility and dispersibility characteristics in a desired liquid carrier that is used to make the copolymer and/or used in the course of preparing the liquid toner particles. Preferably, the liquid carrier (also sometimes referred to as "carrier liquid") is selected such that at least one portion (also referred to herein as S material or block(s)) of the copolymer is more solvated by the carrier while at least one other portion (also referred to herein as D material or block(s)) of the copolymer constitutes more of a dispersed phase in the carrier.

The gel is formed by incorporating a low percentage of each of two monomer types, acidic and basic monomers, in the amphipathic copolymer in an amount sufficient to form a gel. The acidic and basic functionalities may be provided in the S material portion, in the D material portion, or in both the S material portion and D material portion of the amphipathic copolymer. The acidic and basic functionalities form weak, reversible intermolecular non-covalent bonds resulting from acid/base interactions between dispersed amphipathic copolymer particles, thereby forming a gel organosol. In an alternative embodiment of the present invention, the amphipathic copolymer is optionally provided with only acid or base functionality, and an additional bridging compound having at least two of the opposite acid or base functionality is provided in the organosol composition. For example, if the amphipathic copolymer is provided with only acidic functionality, the bridging compound has at least two basic functionalities. The acidic or basic functionalities on the amphipathic copolymer form weak, reversible intermolecular non-covalent bonds with the corresponding the acidic or basic functionalities on the bridging compound, thereby forming a gel organosol.

The gel organosols provide a new approach to improving the sedimentation and redispersion properties of pigmented inks. The method of inducing gelation does not require manipulation of the relative difference in solubility parameter between the amphipathic copolymer and the carrier solvent into a range (solubility parameter difference greater than 2.5 $MPa^{1/2}$) that acts to reduce agglomeration stability of the amphipathic copolymer. This allows the ink formulator increased flexibility in selection of monomer components of the amphipathic copolymer, as well as greater flexibility in carrier fluid selection.

For example, side-chain crystallizable monomers that have a high degree of solubility in the carrier solvent may be incorporated into the amphipathic copolymer without sacrificing gelation characteristics. The use of crystallizable polymeric moieties to improve the durability of non-gel organosol inks has been disclosed in U.S. Pat. No. 5,886,067. Heretofore, the use of such crystallizable polymeric moieties at high weight percentages in an amphipathic copolymer has prevented the formation of gel organosols owing to the relative solubility parameter difference between the amphipathic copolymer and the carrier solvent falling in the range of good solubility (0–2.5 $MPa^{1/2}$). It would be advantageous to combine the characteristics of a gel organosol and a controlled-crystallinity organosol into a single composition.

Preferably, the toner particles additionally comprise at least one visual enhancement additive.

In preferred embodiments, the copolymer is polymerized in situ in the desired liquid carrier. The use of the carrier liquid as the reaction solvent facilitates the formation of substantially monodisperse copolymeric particles suitable for use in toner compositions. The resulting organosol is then preferably mixed with at least one visual enhancement additive and optionally one or more other desired ingredients to form a liquid toner. During such combination, ingredients comprising the visual enhancement particles and the copolymer will tend to self-assemble into composite particles having solvated (S) portions and dispersed (D) portions. Specifically, it is believed that the D material of the copolymer will tend to physically and/or chemically interact with the surface of the visual enhancement additive, while the S material helps promote dispersion in the carrier.

DETAILED DESCRIPTION OF PRESENTLY PREFERRED EMBODIMENTS

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

Preferably, the nonaqueous liquid carrier of the organosol is selected such that at least one portion (also referred to herein as the S material or portion) of the amphipathic copolymer is more solvated by the carrier while at least one other portion (also referred to herein as the D material or portion) of the copolymer constitutes more of a dispersed phase in the carrier. In other words, preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier, forming dispersed particles.

From one perspective, the polymer particles when dispersed in the liquid carrier may be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material may also be referred to herein as a "graft stabilizer." The core/shell structure of the binder particles tends to be retained when the particles are dried when incorporated into liquid toner particles.

The solubility of a material, or a portion of a material such as a copolymeric portion, may be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H-RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters*, 2d Ed. CRC Press, Boca Raton, Fla., (1991), for monomers and representative polymers in *Polymer Handbook*, 3rd Ed., J. Brandrup & E. H. Immergut, Eds. John Wiley, N.Y., pp 519–557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier may be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0$MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier.

While not being bound by theory, it is believed that the amphipathic copolymer is non-covalently crosslinked by acid-base interactions to such an extent that it behaves as an extremely high molecular weight copolymer near its incipient phase separation point in the dispersant liquid.

Gel organosols are dispersions in which the attractive interactions between the elements of the dispersed phase are so strong that the whole system develops a rigid network structure and, under small stresses, behaves elastically. The characteristic of organosol gelation is visibly apparent to one skilled in the art. The non-covalently crosslinked acid-base gel organosols rapidly gel to form a voluminous polymer sediment and a substantially clear supernatant layer of carrier liquid upon standing.

While not being bound by theory, it is believed that gelation of the amphipathic copolymer organosol is induced by forming non-covalent bonds between portions of the amphipathic copolymer using weak, reversible acid-base interactions between an acidic polymerizable compound and a basic polymerizable compound. The acidic or basic polymerizable compounds may both be polymerized into the S material portion, the D material portion, or in both the S material portion and the D material portion. It is also possible to prepare two separate and distinct amphipathic copolymer compositions, one containing an acidic or basic polymerizable compound in the S material portion or D material portion, the other containing the basic or acidic polymerizable compound in the S material portion or the D material portion. In this embodiment, gelation would not occur until the two organosols were blended together in amount sufficient to initiate gelation of the composition. The composition may also be provided with an additional polyfunctional bridging compound having at least two of acid or base functionalities to assist in gel formation. Optionally, this additional polyfunctional bridging compound is provided with only acidic functionality together with amphipathic copolymers having only basic functionality, or may be provided with only basic functionality together with amphipathic copolymers having only acidic functionality.

The strength of the gel (and hence sedimentation resistance of the ink) can be readily manipulated by controlling the extent to which the amphipathic copolymer is noncovalently crosslinked. Greater gel strength (greater sedimentation resistance) is obtained by increasing the crosslink density (percentage of acidic or basic polymerizable compound) in the amphipathic copolymer.

Because the Hildebrand solubility of a material may vary with changes in temperature, such solubility parameters are preferably determined at a desired reference temperature such as at 25° C.

Those skilled in the art understand that the Hildebrand solubility parameter for a copolymer, or portion thereof, may be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446–448. Thus, there will be a preferred molecular weight range for a given polymer or portion thereof in order to achieve desired solvating or dispersing characteristics. Similarly, the Hildebrand solubility parameter for a mixture may be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrophotographic toner and the Hildebrand solubility parameters and glass transition temperatures (based on their high molecular weight homopolymers) for some common monomers used in synthesizing organosols.

TABLE I

Hildebrand Solubility Parameters

Solvent Values at 25° C.

| Solvent Name | Kauri-Butanol Number by ASTM Method D1133-54T (ml) | Hildebrand Solubility Parameter ($MPa^{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (45 m.p.)** |
| n-Octadecyl Acrylate | 16.82 | −55 |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209–277 (1989). The $T_g$ listed is for the homopolymer of the respective monomer.
**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity.

Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ).). Particularly preferred carrier liquids have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization may be carried out in any appropriate solvent, and a solvent exchange may be carried out to provide the desired liquid carrier for the toner composition.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The term "macromer" or "macromonomer" refers to an oligomer or polymer having a terminal polymerizable moiety. "Polymerizable crystallizable compound" or "PCC" refers to compounds capable of undergoing polymerization to produce a copolymer wherein at least a portion of the copolymer is capable of undergoing reversible crystallization over a reproducible and well-defined temperature range (e.g. the copolymer exhibits a melting and freezing point as determined, for example, by differential scanning calorimetry). PCC's may include monomers, functional oligomers, functional pre-polymers, macromers or other compounds able to undergo polymerization to form a copolymer. The term "molecular weight" as used throughout this specification means weight average molecular weight unless expressly noted otherwise.

The weight average molecular weight of the amphipathic copolymer of the present invention may vary over a wide range, and may impact imaging performance. The polydispersity of the copolymer also may impact imaging and transfer performance of the resultant liquid toner material. Because of the difficulty of measuring molecular weight for an amphipathic copolymer, the particle size of the dispersed copolymer (organosol) may instead be correlated to imaging and transfer performance of the resultant liquid toner material. Generally, the volume mean particle diameter ($D_v$) of the dispersed graft copolymer particles, determined by laser diffraction particle size measurement, preferably should be in the range 0.1–100 microns, more preferably 0.5–50 microns, even more preferably 1.0–20 microns, and most preferably 2–10 microns.

In addition, a correlation exists between the molecular weight of the solvatable or soluble S portion of the graft copolymer, and the imaging and transfer performance of the resultant toner. Generally, the S portion of the copolymer has a weight average molecular weight in the range of 1000 to about 1,000,000 Daltons, preferably 5000 to 500,000 Daltons, more preferably 50,000 to 400,000 Daltons. It is also generally desirable to maintain the polydispersity (the ratio of the weight-average molecular weight to the number average molecular weight) of the S portion of the copolymer below 15, more preferably below 5, most preferably below 2.5. It is a distinct advantage of the present invention that copolymer particles with such lower polydispersity characteristics for the S portion are easily made in accordance with the practices described herein, particularly those embodiments in which the copolymer is formed in the liquid carrier in situ.

The relative amounts of S and D portions in a copolymer can impact the solvating and dispersibility characteristics of these portions. For instance, if too little of the S portion(s) are present, the copolymer may have too little stabilizing effect to sterically-stabilize the organosol with respect to aggregation as might be desired. If too little of the D portion(s) are present, the small amount of D material may be too soluble in the liquid carrier such that there may be insufficient driving force to form a distinct particulate, dispersed phase in the liquid carrier. The presence of both a solvated and dispersed phase helps the ingredients of particles self assemble in situ with exceptional uniformity among separate particles. Balancing these concerns, the preferred weight ratio of D material to S material is in the range of 1:1 to 20:1, more preferably 2:1 to 15:1, and most preferably 4:1 to 10:1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54–55 (1992).

In the practice of the present invention, values of $T_g$ for the D or S portion of the copolymer were determined using the Fox equation above, although the $T_g$ of the copolymer as a whole may be determined experimentally using, e.g. differential scanning calorimetry. The glass transition temperatures (Tg's) of the S and D portions may vary over a wide range and may be independently selected to enhance manufacturability and/or performance of the resulting liquid toner particles. The Tg's of the S and D portions will depend to a large degree upon the type of monomers constituting such portions. Consequently, to provide a copolymer material with higher Tg, one can select one or more higher Tg monomers with the appropriate solubility characteristics for the type of copolymer portion (D or S) in which the monomer(s) will be used. Conversely, to provide a copolymer material with lower Tg, one can select one or more lower Tg monomers with the appropriate solubility characteristics for the type of portion in which the monomer(s) will be used.

As mentioned above, selection of glass transition temperature of the binder has an impact on conditions in which film forming takes place, and also has impact on the final properties of the image formed by the toner. In addition, the selection of the carrier liquid also impacts the film forming and final product properties of the image formed by the toner. Thus, a binder that has a high $T_g$ may exhibit a lower effective $T_g$ under certain conditions by selection of a carrier liquid that strongly solvates that particular binder composition. Likewise a binder having a lower $T_g$ may not coalesce (i.e. form a film) if the carrier liquid is selected so that the effective $T_g$ is higher than theoretical under conditions of use. Additionally, selection of various monomer components may alter the observed behavior of the binder both on the photoreceptor during image formation and on the final receptor layer due to chemical or steric interactions between components of the binder. For example, as discussed in more detail below, a binder having a theoretically lower $T_g$ may not form a film under certain conditions at or above the theoretical $T_g$ if it contains crystalline moieties that have a high "activation" temperature for melting, but yet may form an excellent film under appropriate processing conditions.

For copolymers useful in liquid toner applications, the copolymer $T_g$ preferably should not be too low or else receptors printed with the toner may experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking issues, yet not so high as to require fusing temperatures approaching the temperatures at which the final image receptor may be damaged, e.g. approaching the autoignition temperature of paper used as the final image receptor. In this regard, incorporation of a polymerizable crystallizable compound (PCC) in the copolymer will generally permit use of a lower copolymer $T_g$ and therefore lower fusing temperatures without the risk of the image blocking at storage temperatures below the melting temperature of the PCC. Desirably, therefore, the copolymer has a $T_g$ of 25°–100° C., more preferably 30°–80° C., and most preferably 40°–70° C.

For copolymers in which the D portion comprises a major portion of the copolymer, the $T_g$ of the D portion will dominate the $T_g$ of the copolymer as a whole. For such copolymers useful in liquid toner applications, it is preferred that the $T_g$ of the D portion fall in the range of 30°–105° C., more preferably 40°–95° C., still more preferably 45°–85° C., most preferably 50° to 65° C. The S portion will generally exhibit a lower $T_g$ than the D portion, and a higher $T_g$ D portion is therefore desirable to offset the $T_g$ lowering effect of the S portion, which may be solvatable. In this regard, incorporation of a polymerizable crystallizable compound (PCC) in the D portion of the copolymer will generally permit use of a lower D portion $T_g$ and therefore lower fusing temperatures without the risk of the image blocking at storage temperatures below the melting temperature of the PCC. Formulation of particles that do not film form under Photoreceptor Image Formation conditions is facilitated by selection of D portion components such that the D material preferably has a $T_g$ of at least about 55° C., and more preferably at least about 65° C.

Blocking with respect to the S portion material is not as significant an issue inasmuch as preferred copolymers comprise a majority of the D portion material having a relatively high $T_g$. Consequently, the $T_g$ of the D portion material will dominate the effective $T_g$ of the copolymer as a whole. However, if the $T_g$ of the S portion is too low, then the particles might tend to aggregate. On the other hand, if the $T_g$ is too high, then the requisite fusing temperature may be too high. Balancing these concerns, the S portion material is preferably formulated to have a $T_g$ of at least 0° C., preferably at least 20° C., more preferably at least 40° C. In this regard, incorporation of a polymerizable crystallizable compound (PCC) in the S portion of the copolymer will generally permit use of a lower S portion $T_g$.

Preferred copolymers of the present invention may be formulated with one or more radiation curable monomers or combinations thereof that help the free radically polymerizable compositions and/or resultant cured compositions to satisfy one or more desirable performance criteria. For example, in order to promote hardness and abrasion resistance, a formulator may incorporate one or more free radically polymerizable monomer(s) (hereinafter "high $T_g$ component") whose presence causes the polymerized material, or a portion thereof, to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state.

The advantages of incorporating High $T_g$ Monomer into the D material portions of the copolymer are further described in assignee's co-pending U.S. patent application Ser. No. 10/612,765 titled ORGANOSOL INCLUDING HIGH $T_g$ AMPHIPATHIC COPOLYMERIC BINDER AND LIQUID TONERS FOR ELECTROPHOTOGRAPHIC APPLICATIONS, and filed on even date, in the names of Julie Y. Qian et al., said co-pending patent application being incorporated herein by reference in its entirety.

An exemplary class of radiation curable monomers that tend to have relatively high $T_g$ characteristics suitable for incorporation into the high $T_g$ component generally comprises at least one radiation curable (meth)acrylate moiety and at least one nonaromatic, alicyclic and/or nonaromatic heterocyclic moiety. Isobornyl (meth)acrylate is a specific example of one such monomer. A cured, homopolymer film formed from isobornyl acrylate, for instance, has a $T_g$ of 110° C. The monomer itself has a molecular weight of 222 g/mole, exists as a clear liquid at room temperature, has a viscosity of 9 centipoise at 25° C., and has a surface tension of 31.7 dynes/cm at 25° C. Additionally, 1,6-Hexanediol di(meth)acrylate is another example of a monomer with high $T_g$ characteristics.

Particularly preferred monomers for use in the D portion of the amphipathic copolymer include trimethyl cyclohexyl methacrylate; ethyl methacrylate; ethyl acrylate; isobornyl (meth)acrylate; 1,6-Hexanediol di(meth)acrylate and methyl methacrylate. Particularly preferred monomers for use in the S portion of the amphipathic copolymer include lauryl methacrylate, 2-hydroxyethyl methacrylate, dimethyl-m-isopropenyl benzyl isocyanate, trimethyl cyclohexyl methacrylate, and ethyl hexyl methacrylate.

The amphipathic copolymer may optionally be provided with a Soluble High $T_g$ Monomer having a $T_g$ greater than about 55° C. (more preferably greater than about 80° C.). By "soluble" in the context of this aspect of the present invention is meant that the absolute difference in Hildebrand solubility parameters between the Soluble High $T_g$ Monomer and the liquid carrier is less than about 2.2 $MPa^{1/2}$.

The advantages of incorporating Soluble High $T_g$ Monomer into the copolymer are further described in assignee's co-pending U.S. patent application Ser. No. 10/612,533, titled ORGANOSOL INCLUDING AMPHIPATHIC COPOLYMERIC BINDER MADE WITH SOLUBLE HIGH $T_g$ MONOMER AND LIQUID TONERS FOR ELECTROPHOTOGRAPHIC APPLICATIONS, and filed on even date, in the names of Julie Y. Qian et al., said co-pending patent application being incorporated herein by reference in its entirety.

Trimethyl cyclohexyl methacrylate (TCHMA) is one example of a high $T_g$ monomer particularly useful in the practice of the present invention. TCHMA has a $T_g$ of 125° C. and tends to be solvatable or soluble in oleophilic solvents. Consequently, TCHMA is easily incorporated into S material. However, if used in limited amounts so as not to unduly impair the insolubility characteristics of D material, some TCHMA can also be incorporated into the D material.

As noted above, the Soluble High $T_g$ soluble monomers are selected so that they have a $T_g$ of at least about 20° C., and wherein the absolute difference in Hildebrand solubility parameters between the Soluble High $T_g$ Monomer and the liquid carrier is less than about 3 $MPa^{1/2}$. Preferably the Soluble High $T_g$ Monomer has a $T_g$ at least about 40° C., more preferably at least about 60° C., and most preferably at least about 100° C. Most preferably, the absolute difference in Hildebrand solubility parameters between the Soluble High $T_g$ Monomer and the liquid carrier is less than about 2.2 $MPa^{1/2}$. Preferably, the Soluble High $T_g$ Monomer is present at a concentration of between about 5 and 30% by weight of the amphipathic copolymer.

Trimethyl cyclohexyl methacrylate (TCHMA) is a particularly preferred example of a Soluble High $T_g$ monomer useful in the practice of the present invention. TCHMA has a $T_g$ of 125° C. and tends to be soluble in oleophilic solvents. Consequently, TCHMA is easily incorporated into S material. However, if used in limited amounts so as not to unduly impair the insolubility characteristics of D material, some TCHMA can also be incorporated into the D material.

A wide variety of one or more different monomeric, oligomeric and/or polymeric materials may be independently incorporated into the S and D portions, as desired. Representative examples of suitable materials include free radically polymerized material (also referred to as vinyl copolymers or (meth)acrylic copolymers in some embodiments), polyurethanes, polyester, epoxy, polyamide, polyimide, polysiloxane, fluoropolymer, polysulfone, combinations of these, and the like. Preferred S and D portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case may be) that participate in polymerization reactions via a free radical mechanism. Representative examples of such functionality include (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl", as used herein, encompasses acryl and/or methacryl.

Free radically polymerizable monomers, oligomers, and/or polymers are advantageously used to form the copolymer in that so many different types are commercially available and may be selected with a wide variety of desired characteristics that help provide one or more desired performance characteristics. Free radically polymerizable monomers, oligomers, and/or monomers suitable in the practice of the present invention may include one or more free radically polymerizable moieties.

Representative examples of monofunctional, free radically polymerizable monomers include styrene, alpha-methylstyrene, substituted styrene, vinyl esters, vinyl ethers, N-vinyl-2-pyrrolidone, (meth)acrylamide, vinyl naphthalene, alkylated vinyl naphthalenes, alkoxy vinyl naphthalenes, N-substituted (meth)acrylamide, octyl (meth)acrylate, nonylphenol ethoxylate (meth)acrylate, N-vinyl pyrrolidone, isononyl (meth)acrylate, isobornyl (meth)acrylate, 2-(2-ethoxyethoxy)ethyl (meth)acrylate, 2-ethylhexyl (meth)acrylate, beta-carboxyethyl (meth)acrylate, isobutyl (meth)acrylate, cycloaliphatic epoxide, alpha-epoxide, 2-hydroxyethyl (meth)acrylate, (meth)acrylonitrile, maleic anhydride, itaconic acid, isodecyl (meth)acrylate, lauryl (dodecyl) (meth)acrylate, stearyl (octadecyl) (meth)acrylate, behenyl (meth)acrylate, n-butyl (meth)acrylate, methyl (meth)acrylate, ethyl (meth)acrylate, hexyl (meth)acrylate, (meth)acrylic acid, N-vinylcaprolactam, stearyl (meth)acrylate, hydroxy functional caprolactone ester (meth)acrylate, isooctyl (meth)acrylate, hydroxyethyl (meth)acrylate, hydroxymethyl (meth)acrylate, hydroxypropyl (meth)acrylate, hydroxyisopropyl (meth)acrylate, hydroxybutyl (meth) acrylate, hydroxyisobutyl (meth)acrylate, tetrahydrofurfuryl (meth)acrylate, isobornyl (meth)acrylate, glycidyl (meth) acrylate vinyl acetate, combinations of these, and the like.

Nitrile functionality may be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth)acrylonitrile, β-cyanoethyl-(meth)acrylate, 2-cyanoethoxyethyl (meth)acrylate, p-cyanostyrene, p-(cyanomethyl)styrene, N-vinylpyrrolidinone, and the like.

Additional functionality may also be incorporated into the copolymer that is renders the copolymer crosslinkable after image development on the final receptor. The advantages of incorporating such crosslinkable functionalities into the copolymer are further described in assignee's co-pending U.S. Patent Application titled ORGANOSOL LIQUID TONER INCLUDING AMPHIPATHIC COPOLYMERIC BINDER HAVING CROSSLINKABLE FUNCTIONALITY, having Ser. No. 60/437,881 and filed on Jan. 3, 2003 in the names of James A. Baker et al., said co-pending patent application being incorporated herein by reference in its entirety.

In certain preferred embodiments, polymerizable crystallizable compounds, e.g. crystalline monomer(s) are incorporated into the copolymer by chemical bonding to the copolymer. The term "crystalline monomer" refers to a monomer whose homopolymeric analog is capable of independently and reversibly crystallizing at or above room temperature (e.g., 22° C.). The term "chemical bonding" refers to a covalent bond or other chemical link between the polymerizable crystallizable compound and one or more of the other constituents of the copolymer. The advantages of incorporating PCC's into the copolymer are further described in assignee's co-pending U.S. patent application Ser. No. 10/612,534 titled ORGANOSOL LIQUID TONER INCLUDING AMPHIPATHIC COPOLYMERIC BINDER HAVING CRYSTALLINE COMPONENT, and filed on even date in the names of Julie Y. Qian et al., said co-pending patent application being incorporated herein by reference in its entirety.

In these embodiments, the resulting toner particles can exhibit improved blocking resistance between printed receptors and reduced offset during fusing. If used, one or more of these crystalline monomers may be incorporated into the S and/or D material, but preferably is incorporated into the D material. Suitable crystalline monomers include alkyl (meth)acrylates where the alkyl chain contains more than 13 carbon atoms (e.g. tetradecyl(meth)acrylate, pentadecyl (meth)acrylate, hexadecyl(meth)acrylate, heptadecyl(meth) acrylate, octadecyl(meth)acrylate, etc). Other suitable crystalline monomers whose homopolymers have melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; polymerizable natural waxes with melting points above 22° C., polymerizable synthetic waxes with melting points above 22° C., and other similar type materials known to those skilled in the art. As described herein, incorporation of crystalline monomers in the copolymer provides surprising benefits to the resulting liquid toner particles.

It will be understood by those skilled in the art that blocking resistance can be observed at temperatures above room temperature but below the crystallization temperature of the polymer portion incorporating the crystalline monomers or other polymerizable crystallizable compound. Improved blocking resistance is observed when the crystalline monomer or PCC is a major component of the S material, preferably greater than 45%, more preferably greater than or equal to 75%, most preferably greater than or equal to 90% of the S material incorporated into the copolymer.

Many crystalline monomers tend to be soluble in oleophilic solvents commonly used as liquid carrier material(s) in an organosol. Thus, crystalline monomers are relatively easily incorporated into S material without impacting desired solubility characteristics. However, if too much of such crystalline monomer were to be incorporated into D material, the resultant D material may tend to be too soluble in the organosol. Yet, so long as the amount of soluble, crystalline monomer in the D material is limited, some amount of crystalline monomer may be advantageously incorporated into the D material without unduly impacting the desired insolubility characteristics. Thus, when present in the D material, the crystalline monomer is preferably provided in an amount of up to about 30%, more preferably up to about 20%, most preferably up to about 5% to 10% of the total D material incorporated into the copolymer.

When crystalline monomers or PCC's are incorporated chemically into the S material, suitable co-polymerizable compounds to be used in combination with the PCC include monomers (including other PCC's) such as 2-ethylhexyl acrylate, 2-ethylhexyl(methacrylate), lauryl acrylate, lauryl methacrylate, octadecyl acrylate, octadecyl(methacrylate), isobornyl acrylate, isobornyl(methacrylate), hydroxy(ethylmethacrylate), and other acrylates and methacrylates.

Suitable free radically reactive oligomer and/or polymeric materials for use in the present invention include, but are not limited to, (meth)acrylated urethanes (i.e., urethane (meth) acrylates), (meth)acrylated epoxies (i.e., epoxy (meth)acrylates), (meth)acrylated polyesters (i.e., polyester (meth)acrylates), (meth)acrylated (meth)acrylics, (meth)acrylated silicones, (meth)acrylated polyethers (i.e., polyether (meth) acrylates), vinyl (meth)acrylates, and (meth)acrylated oils.

Gelation is induced as a result of two weak attractive forces arising from the electron donor-acceptor interaction between a Lewis acid and a Lewis base, as described in Allan F. M. Barton, *Handbook of Solubility and Other Cohesion Parameters* (CRC Press: Boca Raton, Fla., 1991 pp. 71–72). In one embodiment, gelation is induced by incorporating both a Lewis acid-functional and a Lewis base-functional polymerizable compound in the amphipathic copolymer organosol. The Lewis acid and base-functional polymerizable compounds may be incorporated in the S material portion and the D material portion of the organosol. Preferably, the Lewis acid or base-functional polymerizable compound is incorporated into the D material portion of the organosol, and the corresponding Lewis acid or base-functional polymerizable compound needed to form the Lewis acid/base pair is incorporated into the S material portion of the organosol.

In another embodiment, two distinct organosols are prepared, one with an acid-functional polymerizable compound in the D material portion and/or S material portion, and a separate amphipathic copolymer organosol with basic-functional polymerizable compound in the D material portion and/or S material portion. This approach has the advantage that gelation will not occur until the two organosols are blended together, or until links comprising the two distinct organosols are blended together. This permits easy handling of two self-stable organosols until the organosols are combined with a colorant to make a gel ink.

In either of the above embodiments, the composition may optionally be provided with an additional polyfunctional bridging compound having at least two of acid or base functionalities to assist in gel formation.

In a third embodiment, an amphipathic copolymer organosol is prepared having only acid-functional polymerizable compound in the D material portion and/or S material portion. A polyfunctional bridging compound having at least two basic functionalities on the compound is provided in the composition in an amount effective to form a gel.

In a fourth embodiment, an amphipathic copolymer organosol is prepared having only basic-functional polymerizable compound in the D material portion and/or S material portion. A polyfunctional bridging compound having at least two acidic functionalities on the compound is provided in the composition in an amount effective to form a gel.

Suitable Lewis acid polymerizable compounds include acrylic acid, 2-acrylamido-2-methyl propane sulfonic acid, crotonic acid, itaconic acid, maleic acid, methacrylic acid, pentaerythritol dimethacrylate,2-carboxyethyl acrylate, styrene sulfonic acid, and 4-vinyl benzoic acid.

Suitable Lewis base polymerizable compounds include 2-(dimethylamino)ethyl methylate, diacetone acrylamide, acrylamide, allyl alcohol, allyl amine, allyl diethylamine, allyl ethylamine, allyl dimethylamine, allyl hydroxyethyl ether, N-allyl piperidine, p-amino styrene, diallyl amine, bis-diallylamino methane, t-butylamino methacrylate, diethylaminoethyl methacrylate, diallyl methylamine, N,N-diallylmelamine, 2-dimethylaminoethyl methacrylate, dimethylaminopropyl acrylamide, 2-dimethylamino methyl styrene, 3-dimethylamino neopentyl acrylate, 2,3-dihydroxy propyl acrylate, 2-diisopropylaminoethyl methacrylate, 4-hydroxybutyl acrylate, 4-hydroxybutyl methacrylate, 2-hydroxyethyl acrylate, 2-hydroxyethyl methacrylate, 2-hydroxypropyl acrylate, 2-hydroxypropyl methacrylate, 4-hydroxy styrene, vinyl benzene alcohol, vinyl benzene dimethylamine, 2-vinyl pyridine, 4-vinyl pyridine, and N-vinyl-2-pyrrolidone.

The extent of gelation of the acid-base gel organosol may be controlled by manipulating the concentration of acidic or basic polymerizable compound incorporated into the amphipathic copolymer. Generally, a higher concentration of acidic or basic polymerizable compound leads to a higher apparent crosslink density and therefore a stronger gel. However, too high a concentration of acidic or basic polymerizable monomer will cause the amphipathic copolymer to solidify into a solid-like polymer matrix that is not suitable for incorporation into a crosslinked gel organosol. Preferably, 0.1–5.0% w/w, more preferably 0.5–4.0% w/w, most preferably 1.0–3.0% w/w of each polymerizable compound (acid or base) is used. However, the preferred concentration range of acidic or basic polymerizable compound will vary somewhat depending on the specific acidic or basic polymerizable compound. Preferably, the relative amount of Lewis acid polymerizable compound is stoichiometrically matched by the amount of Lewis base polymerizable compound.

Copolymers of the present invention can be prepared by free-radical polymerization methods known in the art, including but not limited to bulk, solution, and dispersion polymerization methods. The resultant copolymers may have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S portion or D portion materials, as the case may be, may be incorporated into the arms and/or the backbone.

Any number of reactions known to those skilled in the art may be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79–106, also incorporated herein by reference.

Representative examples of grafting methods also may use an anchoring group. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

The preferred methodology described above accomplishes grafting via attaching an ethylenically-unsaturated isocyanate (e.g. dimethyl-m-isopropenyl benzylisocyanate, TMI, available from CYTEC Industries, West Paterson, N.J.; or isocyanatoethyl methacrylate, IEM, available from Aldrich Chemical Company, Milwaukee, Wis.) or an epoxy functionality to hydroxyl groups or amine groups in order to provide free radically reactive anchoring groups.

A preferred method of forming a graft copolymer of the present invention involves three reaction steps that are carried out in a suitable substantially nonaqueous liquid carrier in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl(meth)acrylate, ethyl(meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous liquid carrier for the organosol. At this stage, it is believed that the copolymer tends to exist in the liquid carrier as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the liquid carrier. It can be appreciated that the copolymer is thus advantageously formed in the liquid carrier in situ.

Before further processing, the copolymer particles may remain in the reaction solvent. Alternatively, the particles may be transferred in any suitable way into fresh solvent that is the same or different so long as the copolymer has solvated and dispersed phases in the fresh solvent. In either case, the resulting organosol is then converted into toner particles by mixing the organosol with at least one visual enhancement additive. Optionally, one or more other desired ingredients also can be mixed into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier.

In addition to the visual enhancement additive, other additives optionally can be formulated into the liquid toner composition. A particularly preferred additive comprises at least one charge control agent (CCA, charge control additive or charge director). The charge control agent, also known as a charge director, can be included as a separate ingredient and/or included as one or more functional moiety(ies) of the S and/or D material incorporated into the amphipathic copolymer. The charge control agent acts to enhance the chargeability and/or impart a charge to the toner particles. Toner particles can obtain either positive or negative charge depending upon the combination of particle material and charge control agent.

The charge control agent can be incorporated into the toner particles using a variety of methods, such as copolymerizing a suitable monomer with the other monomers used to form the copolymer, chemically reacting the charge control agent with the toner particle, chemically or physically adsorbing the charge control agent onto the toner particle (resin or pigment), or chelating the charge control agent to a functional group incorporated into the toner particle. One preferred method is via a functional group built into the S material of the copolymer.

The charge control agent acts to impart an electrical charge of selected polarity onto the toner particles. Any number of charge control agents described in the art can be used. For example, the charge control agent can be provided it the form of metal salts consisting of polyvalent metal ions and organic anions as the counterion. Suitable metal ions include, but are not limited to, Ba(II), Ca(II), Mn(II), Zn(II), Zr(IV), Cu(II), Al(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, lauric acid, tallic acid, and the like.

Preferred negative charge control agents are lecithin and basic barium petronate. Preferred positive charge control agents include metallic carboxylates (soaps), for example, as described in U.S. Pat. No. 3,411,936 (incorporated herein by reference). A particularly preferred positive charge control agent is zirconium tetraoctoate (available as Zirconium HEX-CEM from OMG Chemical Company, Cleveland, Ohio).

The preferred charge control agent levels for a given toner formulation will depend upon a number of factors, including the composition of the S portion and the organosol, the molecular weight of the organosol, the particle size of the organosol, the D:S ratio of the polymeric binder, the pigment used in making the toner composition, and the ratio of organosol to pigment. In addition, preferred charge control agent levels will depend upon the nature of the electrophotographic imaging process. The level of charge control agent can be adjusted based upon the parameters listed herein, as known in the art. The amount of the charge control agent, based on 100 parts by weight of the toner solids, is generally in the range of 0.01 to 10 parts by weight, preferably 0.1 to 5 parts by weight.

The conductivity of a liquid toner composition can be used to describe the effectiveness of the toner in developing electrophotographic images. The liquid toners of the present invention are particularly suited for high solids discharge area development, e.g. 5–25%, and more preferably 8–15%. At these concentration ranges, the conductivity is preferably from about $1\times10^{-11}$ mho/cm to about $3\times10^{-10}$ mho/cm, and more preferably from about $5\times10^{-11}$ mho/cm to about $2.5\times10^{-10}$ mho/cm. High conductivities generally indicate inefficient association of the charges on the toner particles and is seen in the low relationship between current density and toner deposited during development. Low conductivities indicate little or no charging of the toner particles and lead to very low development rates. The use of charge control agents matched to adsorption sites on the toner particles is a common practice to ensure sufficient charge associates with each toner particle.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the toner particles is in the range of about 0.05 to about 50.0 microns, more preferably in the range of about 1.5 to about 10 microns, most preferably in the range of about 3 to about 5 microns.

The gel organosols of the present invention have been used to fabricate liquid electrophotographic toners that exhibit excellent imaging characteristics in liquid immersion development. For example, the gel organosol liquid toners exhibit low bulk conductivity, low free phase conductivity, low charge/mass and high mobility, all desirable characteristics for producing high resolution, background free images with high optical density. In particular, the low bulk conductivity, low free phase conductivity and low charge/mass of the toners allow them to achieve high developed optical density over a wide range of solids concentrations, thus improving their extended printing performance relative to conventional toners.

Color liquid toners made according to this invention on development form substantially transparent films which transmit incident light at selected wavelengths (preferably >700 nm, more preferably >780 nm), consequently allowing the photoconductor layer to discharge, while non-coalescent particles scatter a portion of the incident light. Non-coalesced toner particles therefore result in the decreasing of the sensitivity of the photoconductor to subsequent exposures and consequently there is interference with the overprinted image. This also permits latent image generation by Infrared laser scanning devices.

While the electrostatic charge of either the toner particles or photoreceptive element may be either positive or negative, electrophotography as employed in the present invention is preferably carried out by dissipating charge on a positively charged photoreceptive element. A positively-charged toner is then applied to the regions in which the positive charge was dissipated using a liquid toner development technique.

The substrate for receiving the image from the photoreceptive element can be any commonly used receptor material, such as paper, coated paper, polymeric films and primed or coated polymeric films. Polymeric films include polyesters and coated polyesters, polyolefins such as polyethylene or polypropylene, plasticized and compounded polyvinyl chloride (PVC), acrylics, polyurethanes, polyethylene/acrylic acid copolymer, and polyvinyl butyrals. The polymer film may be coated or primed, e.g. to promote toner adhesion.

In electrophotographic processes, the toner composition preferably is Provided at a solids content of about 1–30%, more preferably 3–25%, and most preferably 5–20%. In electrostatic processes, the toner composition preferably is provided at a solids content of 3–15%.

In a particularly preferred aspect of the present invention, toner compositions are provided having a toner solids content of from about 20 to about 40%. These compositions are particularly suited for electrostatic imaging transfer processes wherein the image is transferred from a photoconductive surface to another surface by a system comprising electrostatic forces to assist in the transfer of the image, without film formation prior to or during the image transfer step. Such systems are described, for example, in US Patent Application Nos. 2002/0110390 and 2003/0044202, the disclosures of which are incorporated herein by reference.

These and other aspects of the present invention are demonstrated in the illustrative examples that follow.

EXAMPLES

Test Methods and Apparatus

In the following examples, percent solids of the copolymer solutions and the organosol and ink dispersions were determined gravimetrically using the Halogen Lamp Drying Method using a halogen lamp drying oven attachment to a precision analytical balance (Mettler Instruments, Inc., Highstown, N.J.). Approximately two grams of sample were used in each determination of percent solids using this sample dry down method.

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using tetrahydrofuran as the carrier solvent. Absolute weight average molecular weight were determined using a Dawn DSP—F light scattering detector (Wyatt Technology Corp., Santa Barbara, Calif.), while polydispersity was evaluated by ratioing the measured weight average molecular weight to a value of number average molecular weight determined with an Optilab 903 differential refractometer detector (Wyatt Technology Corp., Santa Barbara, Calif.).

Organosol and toner particle size distributions were determined by the Laser Diffraction Laser Diffraction Light Scattering Method using a Horiba LA-900 laser diffraction particle size analyzer (Horiba Instruments, Inc., Irvine, Calif.). Samples are diluted approximately 1/500 by volume and sonicated for one minute at 150 watts and 20 kHz prior to measurement. Particle size was expressed as both a number mean diameter ($D_n$) and a volume mean diameter ($D_v$) and in order to provide an indication of both the fundamental (primary) particle size and the presence of aggregates or agglomerates.

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 5° C. for 1–2 hours at 6,000 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

Toner particle electrophoretic mobility (dynamic mobility) was measured using a Matec MBS-8000 Electrokinetic Sonic Amplitude Analyzer (Matec Applied Sciences, Inc., Hopkinton, Mass.). Unlike electrokinetic measurements based upon microelectro-phoresis, the MBS-8000 instrument has the advantage of requiring no dilution of the toner sample in order to obtain the mobility value. Thus, it is possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counter-ions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant.

The charge per mass measurement (Q/M) was measured using an apparatus that consists of a conductive metal plate, a glass plate coated with Indium Tin Oxide (ITO), a high voltage power supply, an electrometer, and a personal computer (PC) for data acquisition. A 1% solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 30 minutes at 50° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (O) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

In the following examples, toner was printed onto final image receptors using the following methodology (referred to in the Examples as the Liquid Electrophotographic Printing Method):

A light sensitive temporary image receptor (organic photoreceptor or "OPC") was charged with a uniform positive charge of approximately 850 volts. The positively charged surface of the OPC was image-wise irradiated with a scanning infrared laser module in order to reduce the charge wherever the laser struck the surface. Typical charge-reduced values were between 50 volts and 100 volts.

A developer apparatus was then utilized to apply the toner particles to the OPC surface. The developer apparatus included the following elements: a conductive rubber developer roll in contact with the OPC, liquid toner, a conductive deposition roll, an insulative foam cleaning roll in contact with developer roll surface, and a conductive skiving blade (skive) in contact with the developer roll. The contact area between the developer roll and the OPC is referred to as the "developing nip." The developer roll and conductive deposition roll were both partially suspended in the liquid toner. The developer roll delivered liquid toner to the OPC surface, while the conductive deposition roll was positioned with its roll axis parallel to the developer roll axis and its surface arranged to be approximately 150 microns from the surface of the developer roll, thereby forming a deposition gap.

During development, toner was initially transferred to the developer roll surface by applying a voltage of approximately 500 volts to the conductive developer roll and applying a voltage of 600 volts to the deposition roll. This created a 100-volt potential between the developer roll and the deposition roll so that in the deposition gap, toner particles (which were positively charged) migrated to the surface of the developer roll and remained there as the developer roll surface exited from the liquid toner into the air.

The conductive metal skive was biased to at least 600 volts (or more) and skived liquid toner from the surface of the developer roll without scraping off the toner layer that was deposited in the deposition gap. The developer roll surface at this stage contained a uniformly thick layer of toner at approximately 25% solids. As this toner layer passed through the developing nip, toner was transferred from the developer roll surface to the OPC surface in all the discharged areas of the OPC (the charge image), since the toner particles were positively charged. At the exit of the developing nip, the OPC contained a toner image and the developer roll contained a negative of that toner image which was subsequently cleaned from the developer roll surface by encountering the rotating foam cleaning roll.

The developed latent image (toned image) on the photoreceptor was subsequently transferred to the final image receptor without film formation of the toner on the OPC. Transfer was effected either directly to the final image receptor, or indirectly using an electrostatically-assisted offset transfer to an Intermediate Transfer Belt (ITB), with subsequent electrostatically-assisted offset transfer to the final image receptor. Smooth, clay coated papers were preferred final image receptors for direct transfer of a non-film formed toner from the photoreceptor, while plain, uncoated 20 pound bond paper was a preferred final image receptor for offset transfer using an electrostatic assist. Electrostatically-assisted transfer of non film-formed toner was most effective when the transfer potential (potential difference between the toner on the OPC and the paper back-up roller for direct transfer; or potential difference between the toner on the OPC and the ITB for offset transfer) was maintained in the range of 200–1000 V or 800–2000 V, respectively.

Materials

The following abbreviations are used in the examples:

LMA: lauryl methacrylate
TCHMA: trimethyl cyclohexyl methacrylate
BHA: behenyl acrylate
ODA: octadecyl acrylate
EA: ethyl acrylate
EMA: ethyl methacrylate
EHMA: 2-ethylhexyl methacrylate
HEMA: 2-hydroxyethyl methacrylate
MAA: methacrylic acid
AAM: acrylamide
DMAEMA: 2-(dimethylamino)ethyl methylate
DAAM: diacetone acrylamide
SSA: styrene sulfonic acid
CEA: 2-carboxyethyl acrylate
TMI: dimethyl-m-isopropenyl benzyl isocyanate
V-601: initiator, dimethyl 2,2'-azobisisobutyrate
DBTDL: catalyst, dibutyl tin dilaurate Nomenclature In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) is designated TCHMA/HEMA-TMI (97/3-4.7) is made by copolymerizing, on a relative basis, 97 parts by weight TCHMA and 3 parts by weight HEMA, and this hydroxy functional polymer was reacted with 4.7 parts by weight of TMI.

Examples 1–11

Preparation of Copolymer S Materials, also Referred to herein as "Graft Stabilizers"

Example 1 (Comparative)

A 32 ounce (0.96 liter), narrow-mouthed glass bottle was charged with 475 g of Norpar™ 12, 158 g of TCHMA, 5.0 g of 98% HEMA and 2.44 g of V-601. The bottle was purged for 1 minute with dry nitrogen at a rate of approximately 1.5 liters/minute, and then sealed with a screw cap fitted with a Teflon liner. The cap was secured in place using electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 RPM with a water bath temperature of 70° C. The mixture was allowed to react for approximately 16–18 hours, at which time the conversion of monomer to polymer was quantitative. The mixture was heated to 90° C. for 1 hour to destroy any residual V-601, and then was cooled to room temperature.

The bottle was then opened and 2.5 g of 95% DBTDL and 7.6 g of TMI were added to cooled mixture. The bottle was sealed with a screw cap fitted with Teflon liner. The cap was secured in place using electrical tape. The sealed bottle was then inserted into a metal cage assembly and installed on the agitator assembly of the Atlas Launder-Ometer. The Launder-Ometer was operated at its fixed agitation speed of 42 RPM with a water bath temperature of 70° C. The mixture was allowed to react for approximate 4–6 hours, at which time the conversion of monomer to polymer was quantitative. The cooled mixture was a viscous, clear solution, containing no visible insoluble mater.

The percent solids of the liquid mixture was determined to be 26.00% using the Halogen Lamp Drying Method described above. Subsequent determination of molecular weight was made using the GPC method described above; the copolymer had a $M_w$ of 273,500 Da and $M_w/M_n$ of 2.6 based upon two independent measurements. The product is a copolymer of TCHMA and HEMA containing random side chains of TMI and is designed herein as TCHMA/HEMA-TMI (97/3-4.7% w/w) and is suitable for making an organosol containing no functional groups.

Example 2

A 5000 ml 3-neck round flask equipped with a condenser, a thermocouple connected to a digital temperature controller, a nitrogen inlet tube connected to a source of dry nitrogen and a magnetic stirrer, was charged with a mixture of 2557 g of Norpar™ 12, 823 g of LMA, 26.6 g of DMAEMA, 26.8 g of 98% HEMA and 13.13 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

The mixture was heated to 90° C. and held at that temperature for 1 hour to destroy any residual V-601, then was cooled back to 70° C. The nitrogen inlet tube was then removed, and 13.6 g of 95% DBTDL were added to the mixture, followed by 41.1 g of TMI. The TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/minute. The mixture was allowed to react at 70° C. for 6 hours, at which time the conversion was quantitative.

The mixture was then cooled to room temperature. The cooled mixture was viscous, transparent solution, containing no visible insoluble matter.

The percent solids of the liquid mixture was determined to be 25.01% using the Halogen Lamp Drying Method described above. Subsequent determination of molecular weight was made using the GPC method described above; the copolymer had a $M_w$ of 132,400 Da and $M_w/M_n$ of 2.3 based upon two independent measurements. The product is a copolymer of LMA, DMAEMA and HEMA containing random side chains of TMI and is designed herein as LMA/HEMA/DMAEMA-TMI (94/3/3-4.7% w/w) and is suitable for making a gel organosol containing a basic functional group.

Example 3

Using the method and apparatus of Example 1, 475 g of Norpar™ 12, 153 g of TCHMA, 5 g of 98% HEMA, 4.9 g of DMAEMA and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was viscous, slightly cloudy solution, containing some insoluble matter.

The percent solids of the liquid mixture was determined to be 26.70% using the Halogen Lamp Drying Method described above. Subsequent determination of molecular weight was made using the GPC method described above; the copolymer had a $M_w$ of 216,800 Da and $M_w/M_n$ of 2.7 based upon two independent measurements. The product is a copolymer of TCHMA, DMAEMA and HEMA containing random side chains of TMI and is designed herein as TCHMA/HEMA/DMAEMA-TMI (94/3/3-4.7% w/w) and is suitable for making a gel organosol containing a basic functional group.

Example 4

Using the method and apparatus of Example 1, 475 g of Norpar™ 12, 153 g of ODA, 5 g of 98% HEMA, 4.9 g of DAAM and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was viscous, transparent solution, containing no visible insoluble matter.

The percent solids of the liquid mixture was determined to be 25.00% using the Halogen Lamp Drying Method described above. Subsequent determination of molecular weight was made using the GPC method described above; the copolymer had a $M_w$ of 113,110 Da and $M_w/M_n$ of 1.6 based upon two independent measurements. The product is a copolymer of ODA, DAAM and HEMA containing random side chains of TMI and is designed herein as ODA/HEMA/DAAM-TMI (94/3/3-4.7% w/w) and is suitable for making a gel organosol containing a basic functional group.

Example 5

Using the method and apparatus of Example 1, 475 g of Norpar™ 12, 153 g of BHA, 5 g of 98% HEMA, 4.9 g of DAAM and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was viscous, slightly cloudy solution, containing some visible insoluble matter.

The percent solids of the liquid mixture was determined to be 24.28% using the Halogen Lamp Drying Method described above. Subsequent determination of molecular weight was made using the GPC method described above; the copolymer had a $M_w$ of 125,800 Da and $M_w/M_n$ of 3.5 based upon two independent measurements. The product is a copolymer of BHA, DAAM and HEMA containing random side chains of TMI and is designed herein as BHA/HEMA/DAAM-TMI (94/3/3-4.7% w/w) and is suitable for making a gel organosol containing a basic functional group.

Example 6

Using the method and apparatus of Example 1, 475 g of Norpar™ 12, 153 g of EHMA, 5 g of 98% HEMA, 4.9 g of AAM and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was viscous, slight cloudy solution, containing some visible insoluble matter.

The percent solids of the liquid mixture was determined to be 25.02% using the Halogen Lamp Drying Method described above. Subsequent determination of molecular weight was made using the GPC method described above; the copolymer had a $M_w$ of 209,100 Da and $M_w/M_n$ of 2.8 based upon two independent measurements. The product is a copolymer of EHMA, AAM and HEMA containing random side chains of TMI and is designed herein as EHMA/HEMA/AAM-TMI (94/3/3-4.7% w/w) and is suitable for making a gel organosol containing a basic functional group.

Example 7

Using the method and apparatus of Example 2, 2556 g of Norpar™ 12, 836 g of LMA, 13.4 g of MAA, 26.8 g of 98% HEMA and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 13.6 g of 95% DBTDL and 41.1 g of TMI. The TMI was added drop wise over the course of approximately 5 minutes while stirring the reaction mixture. Following the procedure of Example 1, the mixture was reacted at 70° C. for approximately 6 hours at which time the reaction was quantitative. The mixture was then cooled to room temperature. The cooled mixture was clear gel, containing no phase-separated polymer.

The percent solids of the liquid mixture was determined to be 24.23% using the Halogen Lamp Drying Method described above. Subsequent determination of molecular weight was made using the GPC method described above; the copolymer had a $M_w$ of 146,600 Da and $M_w/M_n$ of 2.4 based upon two independent measurements. The product is a copolymer of LMA, MAA and HEMA containing random side chains of TMI and is designed herein as LMA/HEMA/MAA-TMI (95.5/3/1.5-4.7% w/w) and is suitable for making a gel organosol containing an acid function group.

Example 8

Using the method and apparatus of Example 1, 475 g of Norpar™ 12, 155 g of TCHMA, 2.5 g of MAA, and 5 g of 98% HEMA and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was thick clear gel, containing no phase-separated polymer.

The percent solids of the liquid mixture was determined to be 26.09% using the Halogen Lamp Drying Method described above. Subsequent determination of molecular weight was made using the GPC method described above; the copolymer had a $M_w$ of 277,600 Da and $M_w/M_n$ of 2.8 based upon two independent measurements. The product is a copolymer of TCHMA, MAA and HEMA containing random side chains of TMI and is designed herein as TCHMA/HEMA/MAA-TMI (95.5/3/1.5-4.7% w/w) and is suitable for making a gel organosol containing an acid functional group.

Example 9

Using the method and apparatus of Example 1, 475 g of Norpar™ 12, 153 g of ODA, 4.9 g of SSA, and 5 g of 98% HEMA and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was viscous slightly cloudy solution, containing phase-separated polymer.

The percent solids of the liquid mixture was determined to be 25.02% using the Halogen Lamp Drying Method described above. Subsequent determination of molecular weight was made using the GPC method described above; the copolymer had a $M_w$ of 95,810 Da and $M_w/M_n$ of 2.6 based upon two independent measurements. The product is a copolymer of ODA, SSA and HEMA containing random side chains of TMI and is designed herein as ODA/HEMA/SSA-TMI (94/3/3-4.7% w/w) and is suitable for making a gel organosol containing an acid functional group.

Example 10

Using the method and apparatus of Example 1, 475 g of Norpar™ 12, 153 g of BHA, 4.9 g of SSA, and 5 g of 98% HEMA and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was viscous slightly cloudy solution, containing phase-separated polymer.

The percent solids of the liquid mixture was determined to be 24.56% using the Halogen Lamp Drying Method described above. Subsequent determination of molecular weight was made using the GPC method described above; the copolymer had a $M_w$ of 104,000 Da and $M_w/M_n$ of 2.5 based upon two independent measurements. The product is a copolymer of BHA, SSA and HEMA containing random side chains of TMI and is designed herein as BHA/HEMA/SSA-TMI (94/3/3-4.7% w/w) and is suitable for making a gel organosol containing an acid functional group.

Example 11

Using the method and apparatus of Example 1, 475 g of Norpar™ 12, 153 g of EHMA, 4.9 g of SSA, and 5 g of 98% HEMA and 2.44 g of V-601 were combined and resulting mixture reacted at 70° C. for 16 hours. The mixture was then heated to 90° C. for 1 hour to destroy any residual V-601, then was cooled back to 70° C. To the cooled mixture was then added 2.5 g of 95% DBTDL and 7.6 g of TMI. Following the procedure of Example 1, the mixture was reacted at 70° C. for approximately 6 hours at which time the reaction was quantitative. The mixture was then cooled to room temperature. The cooled mixture was clear gel, containing no phase-separated polymer.

The percent solids of the liquid mixture was determined to be 24.95% using the Halogen Lamp Drying Method described above. Subsequent determination of molecular weight was made using the GPC method described above; the copolymer had a $M_w$ of 139,800 Da and $M_w/M_n$ of 1.7 based upon two independent measurements. The product is a copolymer of EHMA, CEA and HEMA containing random side chains of TMI and is designed herein as EHMA/HEMA/CEA-TMI (94/3/3-4.7% w/w) and is suitable for making a gel organosol containing an acid functional group.

The compositions of the graft stabilizers of Examples 1–11 are summarized in the following table:

TABLE II

Graft Stabilizers

| Example Number | Composition (% w/w) | Acid or Basic Group | Appearance |
|---|---|---|---|
| 1 (Comp.) | TCHMA/HEMA-TMI (97/3–4.7) | None | Clear solution, no insoluble polymer. |
| 2 | LMA/DMAEMA/HEMA-TMI (94/3/3–4.7) | DMAEMA (Base) | Clear solution, no insoluble polymer |
| 3 | TCHMA/DMAEMA/HEMA-TMI (94/3/3–4.7) | DMAEMA (Base) | Slightly cloudy solution. |
| 4 | ODA/DAAM/HEMA-TMI (94/3/3–4.7) | DAAM (Base) | Clear solution, no insoluble polymer |
| 5 | BHA/DAAM/HEMA-TMI (94/3/3–4.7) | DAAM (Base) | Slightly cloudy solution. |
| 6 | EHMA/AAM/HEMA-TMI (94/3/3–4.7) | AAM (Base) | Cloudy solution, phase-separated polymer. |
| 7 | LMA/MAA/HEMA-TMI (95.5/3/1.5–4.7) | MAA (Acid) | Clear gel, no insoluble polymer. |
| 8 | TCHMA/MAA/HEMA-TMI (95.5/3/1.5–4.7) | MAA (Acid) | Clear gel, no insoluble polymer. |
| 9 | ODA/SSA/HEMA-TMI (94/3/3–4.7) | SSA (Acid) | Slightly cloudy solution. |
| 10 | BHA/SSA/HEMA-TMI (94/3/3–4.7) | SSA (Acid) | Slightly cloudy solution. |

TABLE II-continued

Graft Stabilizers

| Example Number | Composition (% w/w) | Acid or Basic Group | Appearance |
|---|---|---|---|
| 11 | EHMA/CEA/HEMA-TMI (94/3/3–4.7) | CEA (Acid) | Clear gel, no insoluble polymer |

Examples 12–22

Addition of D Material to Form Organosols

Example 12 (Comparative)

This is a comparative example using the graft stabilizer in Example 1 to prepare an organosol which containing no functional group. A 32 ounce (0.96 liter), narrow-mouthed glass bottle was charged with 126 g of Norpar™ 12, 14.6 g of EMA, 1.4 g of EA, 7.7 g of the graft stabilizer mixture from Example 1 at 26.00% polymer solids, and 0.18 g of V-601. The bottle was purged for 1 minute with dry nitrogen at a rate of approximately 1.5 liters/minute, then sealed with a screw cap fitted with a Teflon liner. The cap was secured in place using electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 RPM with a water bath temperature of 70° C. The mixture was allowed to react for approximately 16–18 hours, at which time the conversion of monomer to polymer was quantitative. The mixture was cooled to room temperature, yielding an opaque white dispersion.

This organosol was designated TCHMA/HEMA-TMI//EA/EMA (97/3-4.7//13/87% w/w). The percent solids of the organosol dispersion was determined to be 11.07% using the Halogen Lamp Drying Method described above. Subsequent determination of average particle size was made using the Laser Diffraction Analysis described above; the organosol had a volume average diameter of 8.6 μm.

Example 13 (Comparative)

A 5000 ml 3-neck round flask equipped with a condenser, a thermocouple connected to a digital temperature controller, a nitrogen inlet tube connected to a source of dry nitrogen and a magnetic stirrer, was charged with a mixture of 2937 g of Norpar™ 12, 324.8 g of EMA, 48.5 g of EA, 185.2 g of the graft stabilizer mixture from Example 2 at 25.20% polymer solids, and 4.20 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative. The mixture was cooled to room temperature, yielding an opaque white dispersion which contained a basic functional group in the S portion of the organosol.

Approximately 350 g of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white dispersion.

This organosol was designated LMA/HEMA/DMAEMA-TMI//EA/EMA (94/3/3-4.7//13/87% w/w). The percent solids of the organosol dispersion after stripping was determined to be 14.60% using the Halogen Lamp Drying Method described above. Subsequent determination of average particle size was made using the Laser Diffraction Analysis described above; the organosol had a volume average diameter of 0.24 μm.

Example 14 (Comparative)

Using the method and apparatus of Example 13, 2930 g of Norpar™ 12, 324.8 g of EMA, 48.5 g of EA, 192.6 g of the graft stabilizer mixture from Example 7 at 24.23% polymer solids, and 4.20 g of V-601 were combined and resulting mixture reacted at 70° C. for 16 hours. The mixture was cooled to room temperature.

After stripping the organosol using the method of Example 13 to remove residual monomer, the stripped organosol was cooled to room temperature, yielding an opaque white dispersion which contained an acid functional group in the S portion of the organosol.

This organosol was designated LMA/HEMA/MAA-TMI//EA/EMA (96.5/3/1.5-4.7//13/87% w/w). The percent solids of the organosol dispersion was determined to be 16.30% using the Halogen Lamp Drying Method described above. Subsequent determination of average particle size was made using the Laser Diffraction Analysis described above; the organosol had a volume average diameter of 0.24 μm.

Example 15 (Comparative)

Using the method and apparatus of Example 13, 2943 g of Norpar™ 12, 315.1 g of EMA, 47.0 g of EA, 10.9 g of DMAEMA and 179.5 g of the graft stabilizer mixture from Example 1 at 26.00% polymer solids, and 4.20 g of V-601 were combined and resulting mixture reacted at 70° C. for 16 hours. The mixture was cooled to room temperature, After stripping the organosol using the method of Example 13 to remove residual monomer, the stripped organosol was cooled to room temperature, yielding an opaque white dispersion which contained a basic functional group in the D portion of the organosol.

This organosol was designated TCHMA/HEMA-TMI//EA/EMA/DMAEMA (97/3-4.7//2.6/84.4/3% w/w). The percent solids of the organosol dispersion was determined to be 12.24% using the Halogen Lamp Drying Method described above. Subsequent determination of average particle size was made using the Laser Diffraction Analysis described above; the organosol had a volume average diameter of 8.9 μm.

Example 16 (Comparative)

Using the method and apparatus of Example 13, 2943 g of Norpar™ 12, 321.5 g of EMA, 48.1 g of EA, 3.7 g of MAA, and 179.5 g of the graft stabilizer mixture from Example 1 at 26.00% polymer solids, and 4.20 g of V-601 were combined and resulting mixture reacted at 70° C. for 16 hours. The mixture was cooled to room temperature.

After stripping the organosol using the method of Example 13 to remove residual monomer, the stripped organosol was cooled to room temperature, yielding an opaque white dispersion which contained an acid functional group in the D portion of the organosol.

This organosol was designated TCHMA/HEMA-TMI//EA/EMA/MAA (97/3-4.7//12.9/86.1/1% w/w). The percent solids of the organosol dispersion was determined to be 12.25% using the Halogen Lamp Drying Method described above. Subsequent determination of average particle size was made using the Laser Diffraction Analysis described above; the organosol had a volume average diameter of 71.8 μm.

Example 17 (Comparative)

Using the method and apparatus of Example 12, 126 g of Norpar™ 12, 10.5 g of EMA, 5.0 g of EA, 0.5 g of DAAM, and 8.0 g of the graft stabilizer mixture from Example 4 at 25.00% polymer solids, and 0.18 g of V-601 were combined and resulting mixture reacted at 70° C. for 16 hours. The mixture was cooled to room temperature, yielding an opaque white dispersion which contained basic functional groups in the both S and D portion of the organosol.

This organosol was designated ODA/HEMA/DAAM-TMI//EA/EMA/DAAM (94/3/3-4.7//21.3/75.7/3% w/w). The percent solids of the organosol dispersion was determined to be 11.41% using the Halogen Lamp Drying Method described above. Subsequent determination of average particle size was made using the Laser Diffraction Analysis described above; the organosol had a volume average diameter of 0.27 μm.

Example 18 (Comparative)

Using the method and apparatus of Example 12, 126 g of Norpar™ 12, 10.7 g of EMA, 5.1 g of EA, 0.2 g of SSA, and 8.0 g of the graft stabilizer mixture from Example 9 at 25.02% polymer solids, and 0.18 g of V-601 were combined and resulting mixture reacted at 70° C. for 16 hours. The mixture was cooled to room temperature, yielding an opaque white dispersion which contained acid functional groups in the both S and D portion of the organosol.

This organosol was designated ODA/HEMA/SSA-TMI//EA/EMA/SSA (94/3/3-4.7//31.7/67.3/1% w/w). The percent solids of the organosol dispersion was determined to be 11.37% using the Halogen Lamp Drying Method described above. Subsequent determination of average particle size was made using the Laser Diffraction Analysis described above; the organosol had a volume average diameter of 0.33 μm.

Example 19

Using the method and apparatus of Example 12, 126 g of Norpar™ 12, 10.5 g of EMA, 5.0 g of EA, 0.5 g of DAAM, and 8.1 g of the graft stabilizer mixture from Example 10 at 24.56% polymer solids, and 0.18 g of V-601 were combined and resulting mixture reacted at 70° C. for 16 hours. The mixture was cooled to room temperature, yielding an opaque white dispersion which contained an acid functional group in the S and a basic functional group in the D portion of the organosol.

This organosol was designated BHA/HEMA/SSA-TMI//EA/EMA/DAAM (94/3/3-4.7//31/66/3% w/w). The percent solids of the organosol dispersion was determined to be 10.83% using the Halogen Lamp Drying Method described above. Subsequent determination of average particle size was made using the Laser Diffraction Analysis described above; the organosol had a volume average diameter of 14.4 μm.

Example 20

Using the method and apparatus of Example 12, 126 g of Norpar™ 12, 10.7 g of EMA, 5.1 g of EA, 0.2 g of SSA, and 8.2 g of the graft stabilizer mixture from Example 5 at 24.28% polymer solids, and 0.18 g of V-601 were combined and resulting mixture reacted at 70° C. for 16 hours. The mixture was cooled to room temperature, yielding an opaque white dispersion which contained basic functional group in the S and an acid functional group in the D portion of the organosol.

This organosol was designated BHA/HEMA/DAAM-TMI//EA/EMA/SSA (94/3/3-4.7//31.7/67.3/1% w/w). The percent solids of the organosol dispersion was determined 11.04% using the Halogen Lamp Drying Method described above. Subsequent determination of average particle size was made using the Laser Diffraction Analysis described above; the organosol had a volume average diameter of 13.9 μm.

Example 21 (Comparative)

Using the method and apparatus of Example 12, 126 g of Norpar™ 12, 16.0 g of EMA, and 8.0 g of the graft stabilizer mixture from Example 6 at 25.02% polymer solids, and 0.18 g of V-601 were combined and resulting mixture reacted at 70° C. for 16 hours. The mixture was cooled to room temperature, yielding an opaque white dispersion which contained basic functional group in the S and an acid functional group in the D portion of the organosol.

This organosol was designated EHMA/HEMA/AAM-TMI//EMA (94/3/3-4.7//100% w/w). The percent solids of the organosol dispersion was determined to be 11.72% using the Halogen Lamp Drying Method described above. Subsequent determination of average particle size was made using the Laser Diffraction Analysis described above; the organosol had a volume average diameter of 13.8 μm.

Example 22 (Comparative)

Using the method and apparatus of Example 12, 126 g of Norpar™ 12, 16.0 g of EMA, and 8.2 g of the graft stabilizer mixture from Example 11 at 24.95% polymer solids, and 0.18 g of V-601 were combined and resulting mixture reacted at 70° C. for 16 hours. The mixture was cooled to room temperature, yielding an opaque white dispersion which contained an acid functional group in the S of the organosol.

This organosol was designated EHMA/HEMA/CEA-TMI//EMA (94/3/3-4.7//100% w/w). The percent solids of the organosol dispersion was determined to be 11.63% using the Halogen Lamp Drying Method described above. Subsequent determination of average particle size was made using the Laser Diffraction Analysis described above; the organosol had a volume average diameter of 17.2 μm.

Example 23

20 g of non-gel organosol from example 13, LMA/HEMA/DMAEMA-TM//EA/EMA (94/3/3-4.7//13/87), was mixed with 20 g of the weak gel organosol from example 14, LMA/HEMA/MAA-TMI//EAIEMA (95.5/3/1.5-4.7//13/87), in a 4 ounce glass jar. The result organosol mixture formed a gel on standing over a period of 24 hours.

Example 24

20 g of non-gel organosol from example 15, TCHMA/HEMA-TMI//EA/EMA/DMAEMA (97/3-4.7//12.6/84.4/3), was mixed with 20 g of the gel organosol from example 16, TCHMA/HEMA-TMI//EA/EMA/MAA (97/3-4.7//12.9/86.1/1) in a 4 ounce glass jar. The result organosol mixture formed a hard gel on standing over a period of 2 hours.

Example 25

20 g of non-gel organosol from example 17, ODA/HEMA/DAAM-TMI//EA/EMA/DAAM (94/3/3-4.7//31/66/3), was mixed with 20 g of the non gel organosol from example 18, ODA/HEMA/SSA-TMI//EA/EMAISSA (94/3/3-4.7//31.7/67.3/1), in a 4 ounce glass jar. The result organosol mixture formed a gel on standing over a period of 24 hours.

Example 26

20 g of the self stable gel organosol from example 19, BHA/HEMA/SSA-TMI/EA/EMA/DAAM (94/3/3-4.7//31/66/3), was mixed with 20 g of the self stable gel organosol from example 20, BHA/HEMA/DAAM-TMI//EA/EMA/SSA (94/3/3-4.7//31.7/67.3/1), in a 4 ounce glass jar. The result organosol mixture coagulated on standing over a period of 24 hours.

Example 27

20 g of non-gel organosol from example 21, EHMA/HEMA/AAM-TMI//EMA (94/3/3-4.7//100), was mixed with 20 g of the non gel organosol from example 22, EHMA/HEMA/CEA-TMI//EA/EMA/SSA (94/3/3-4.7//100), in a 4 ounce glass jar. The result organosol mixture formed a gel on standing over a period of 24 hours.

TABLE III

Organosol Examples

| Example Number | Composition (% w/w) | $T_g$ of the D portion (° C.) | Acid or Base in Shell/Core (wt %) | Physical Form |
|---|---|---|---|---|
| 12 (Comp.) | TCHMA/HEMA-TMI//EA/EMA (97/3–4.7//13/87) | 50 | 0/0 | Non-gel |
| 13 | LMA/HEMA/DMAEMA-TMI/EA/EMA (94/3/3–4.7//13/87) | 50 | 3 (DMAEMA)/0 | Non-gel |

TABLE III-continued

Organosol Examples

| Example Number | Composition (% w/w) | $T_g$ of the D portion (° C.) | Acid or Base in Shell/Core (wt %) | Physical Form |
|---|---|---|---|---|
| 14 | LMA/HEMA/MAA-TMI// EA/EMA (95.5/3/1.5–4.7//13/87) | 50 | 1.5 (MAA)/0 | Weak-gel |
| 15 | TCHMA/HEMA-TMI// EA/EMA/DMAEMA (97/3–4.7//12.6/84.4/3) | 50 | 0/3 (DMAEMA) | Non-gel |
| 16 | TCHMA/HEMA-TMI//EA/EMA/MAA (97/3–4.7//12.9/86.1/1) | 50 | 0/1 (MAA) | Gel |
| 17 | ODA/DAAM/HEMA-TMI// EA/EMA/DAAM (94/3/3–4.7//31/66/3) | 30 | 3 (DAAM)/ 3 (DAAM) | Non-gel |
| 18 | ODA/SSA/HEMA-TMI// EA/EMA/SSA (94/3/3–4.7//31.7/67.3/1) | 30 | 3 (SSA)/ 1 (SSA) | Non-gel |
| 19 | BHA/SSA/HEMA-TMI// EA/EMA/DAAM (94/3/3–4.7//31/66/3) | 30 | 3 (SSA)/ 3 (DAAM) | Gel |
| 20 | BHA/DAAM/HEMA-TMI// EA/EMA/SSA (94/3/3–4.7//31.7/67.3/1) | 30 | 3 (DAAM)/ 1 (SSA) | Gel |
| 21 | EHMA/AAM/HEMA-TMI//EMA (94/3/3–4.7//100) | 65 | 3 (AAM)/0 | Non-gel |
| 22 | EHMA/CEA/HEMA-TMI//EMA (94/3/3–4.7//100) | 65 | 3 (CEA)/0 | Non-gel |

TABLE IV

Gel Organosol by Acid and Base Interaction

| Example Number | Composition A (% w/w) | Composition B (% w/w) | Physical Form |
|---|---|---|---|
| 23 | LMA/HEMA-TMI// EA/EMA/DMAEMA (97/6–4.7//12.6/84.6/3)(13) | LMA/HEMA-TMI// EA/EMA/MAA (97/6–4.7//12.9/86.1/1)(14) | Gel |
| 24 | TCHMA/DMAEMA/ HEMA-TMI//EA/EMA (94/3/3–4.7//22/78)(15 | TCHMA/MAA/HEMA-TMI//EA/EMA (94/3/3–4.7//12/78)(16) | Hard gel |
| 25 | ODA/DAAM/HEMA-TMI// EA/EMA/DAAM (94/3/3–4.7//31/66/3)(17) | ODA/SSA/HEMA-TMI// EA/EMA/SSA (94/3/3–4.7//31.7/67.3/1)(18) | Hard-gel |
| 26 | BHA/SSA/HEMA-TMI// EA/EMA/DAAM (94/3/3–4.7//31/66/3)(19) | BHA/DAAM/HEMA-TMI//EA/EMA/SSA (94/3/3–4.7//31.7/67.3/1)(20) | Coagulation |
| 27 | EHMA/AAM/HEMA-TMI//EMA (94/3/3–4.7//100)(21) | EHMA/CEA/HEMA-TMI//EMA (94/3/3–4.7//100)(22) | Gel |

Examples 28–35

Preparation of Liquid Toners

Example 28

For characterization of the prepared liquid toner compositions in these Examples, the following were measured: size-related properties (particle size); charge-related properties (bulk and free phase conductivity, dynamic mobility and zeta potential); and charge/developed reflectance optical density (Z/ROD), a parameter that is directly proportional to the toner charge/mass (Q/M).

This is an example of preparing a magenta liquid toner at a weight ratio of organosol copolymer to pigment of 5 (O/P ratio) using the organosol prepared in example 13 and 14 for which the weight ratio of D material to S material was 8. 98 g of the organosol prepared in example 13 at 14.60% (w/w) solids in Norpar™ 12 and 88 g of the organosol prepared in example 14 at 16.30% (w/w) solids in Norpar™ 12 were combined with 107 g of Norpar™ 12, 6 g of Pigment Red 81:4 (Magruder Color Company, Tucson, Ariz.) and 0.47 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 0.79 micron
Q/M: 129 μC/g
Bulk Conductivity: 288 picoMhos/cm
Percent Free Phase Conductivity: 9.41%
Dynamic Mobility: 6.20E-11 ($m^2$/Vsec).

This toner was tested using the printing procedure described above. The reflection optical density (ROD) was 0.56 at plating voltages greater than 525 volts.

Example 29

This is an example of preparing a black liquid toner at a weight ratio of organosol copolymer to pigment of 6 (O/P ratio) using the organosol prepared in example 13 and 14 for which the weight ratio of D material to S material was 8. 101 g of the organosol prepared in example 13 at 14.60% (w/w) solids in Norpar™ 12 and 91 g of the organosol prepared in example 14 at 16.30% (w/w) solids in Norpar™ 12 were combined with 11 g of Norpar™ 12, 5 g of Black pigment (Aztech EK8200, Magruder Color Company, Tucson, Ariz.) and 0.80 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 0.77 micron
Q/M: 178 μC/g
Bulk Conductivity: 383 picoMhos/cm
Percent Free Phase Conductivity: 14.53%
Dynamic Mobility: 4.27E-11 ($m^2$ Vsec).

This toner was tested using the printing procedure described above. The reflection optical density (ROD) was 0.92 at plating voltages greater than 525 volts. The printed image exhibited good electrostatic transfer properties with no flow pattern and background.

Example 30

This is an example of preparing a cyan liquid toner at a weight ratio of organosol copolymer to pigment of 6 (O/P ratio) using the organosol prepared in example 13 and 14 for which the weight ratio of D material to S material was 8. 101 g of the organosol prepared in example 13 at 14.60% (w/w) solids in Norpar™ 12 and 91 g of the organosol prepared in example 14 at 16.30% (w/w) solids in Norpar™ 12 were combined with 103 g of Norpar™ 12, 5 g of Pigment Blue15:4 (PB:15:4, 249-3450, Sun Chemical Company, Cincinnati, Ohio) and 0.80 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 0.48 micron
Q/M: 197 μC/g
Bulk Conductivity: 76 picoMhos/cm
Percent Free Phase Conductivity: 11.69%
Dynamic Mobility: 1.45E-11 ($m^2$/Vsec).

This toner was tested using the printing procedure described above. The reflection optical density (ROD) was 1.10 at plating voltages greater than 525 volts. The printed image exhibited good electrostatic transfer properties with no flow pattern and background.

Example 31

This is an example of preparing a yellow liquid toner at a weight ratio of organosol copolymer to pigment of 5 (O/P ratio) using the organosol prepared in example 13 and 14 for which the weight ratio of D material to S material was 8. 98 g of the organosol prepared in example 13 at 14.60% (w/w) solids in Norpar™ 12 and 88 g of the organosol prepared in example 14 at 16.30% (w/w) solids in Norpar™ 12 were combined with 107 g of Norpar™ 12, 5.4 g of Pigment Yellow 138, and 0.6 g of Pigment Yellow 83 (Sun Chemical Company, Cincinnati, Ohio) in an 8 ounce glass jar. This mixture was then milled in a 0.5 liter vertical bead mill (Model 6TSG-¼, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 0.81 micron
Q/M: 139 μC/g
Bulk Conductivity: 206 picoMhos/cm
Percent Free Phase Conductivity: 13.84%
DynamicMobility: 3.10E-11 ($m^2$/Vsec).

This toner was tested using the printing procedure described above. The reflection optical density (ROD) was 0.95 at plating voltages greater than 525 volts. The printed image exhibited good electrostatic transfer properties with no flow pattern and background.

Example 32

This is an example of preparing a magenta liquid toner at a weight ratio of organosol copolymer to pigment of 5 (O/P ratio) using the organosol prepared in example 15 and 16 for which the weight ratio of D material to S material was 8. 117 g of the organosol prepared in example 15 at 12.24% (w/w) solids in Norpar™ 12 and 117 g of the organosol prepared in example 16 at 12.25% (w/w) solids in Norpar™ 12 were combined with 59 g of Norpar™ 12, 6 g of Pigment Red 81:4 (Magruder Color Company, Tucson, Ariz.) and 0.82 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 2.38 micron

Q/M: 153 μC/g

Bulk Conductivity: 422 picoMhos/cm

Percent Free Phase Conductivity: 0.63%

Dynamic Mobility: 9.01E-11 ($m^2$/Vsec).

This toner was tested using the printing procedure described above. The reflection optical density (ROD) was 1.33 at plating voltages greater than 525 volts. The printed image exhibited good electrostatic transfer properties with no flow pattern and background.

Example 33

This is an example of preparing a black liquid toner at a weight ratio of organosol copolymer to pigment of 6 (O/P ratio) using the organosol prepared in example 15 and 16 for which the weight ratio of D material to S material was 8. 121 g of the organosol prepared in example 15 at 12.24% (w/w) solids in Norpar™ 12 and 121 g of the organosol prepared in example 16 at 12.25% (w/w) solids in Norpar™ 12 were combined with 53 g of Norpar™ 12, 5 g of Black pigment (Aztech EK8200, Magruder Color Company, Tucson, Ariz.) and 0.40 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 2.38 micron

Q/M: 88 μC/g

Bulk Conductivity: 228 picoMhos/cm

Percent Free Phase Conductivity: 0.47%

Dynamic Mobility: 5.87E-11 ($m^2$/Vsec).

This toner was tested using the printing procedure described above. The reflection optical density (ROD) was 1.28 at plating voltages greater than 525 volts. The printed image exhibited good electrostatic transfer properties with no flow pattern and background.

Example 34

This is an example of preparing a cyan liquid toner at a weight ratio of organosol copolymer to pigment of 6 (O/P ratio) using the organosol prepared in example 15 and 16 for which the weight ratio of D material to S material was 8. 121 g of the organosol prepared in example 15 at 12.24% (w/w) solids in Norpar™ 12 and 121 g of the organosol prepared in example 16 at 12.25% (w/w) solids in Norpar™ 12 were combined with 53 g of Norpar™ 12, 5 g of Pigment Blue15:4 (PB:15:4, 249-3450, Sun Chemical Company, Cincinnati, Ohio) and 0.80 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 2.55 micron

Q/M: 205 μC/g

Bulk Conductivity: 171 picoMhos/cm

Percent Free Phase Conductivity: 0.59%

Dynamic Mobility: 4.99E-11 ($m^2$/Vsec).

This toner was tested using the printing procedure described above. The reflection optical density (ROD) was 1.35 at plating voltages greater than 525 volts. The printed image exhibited excellent electrostatic transfer properties with no flow pattern and background.

Example 35

This is an example of preparing a yellow liquid toner at a weight ratio of organosol copolymer to pigment of 5 (O/P ratio) using the organosol prepared in example 15 and 16 for which the weight ratio of D material to S material was 8. 117 g of the organosol prepared in example 15 at 12.24% (w/w) solids in Norpar™ 12 and 117 g of the organosol prepared in example 16 at 12.25% (w/w) solids in Norpar™ 12 were combined with 59 g of Norpar™ 12, 5.4 g of Pigment Yellow 138, and 0.6 g of Pigment Yellow 83 (Sun Chemical Company, Cincinnati, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 2.68 micron

Q/M: 223 μC/g

Bulk Conductivity: 370 picoMhos/cm

Percent Free Phase Conductivity: 2.58%

Dynamic Mobility: 9.69E-11 ($m^2$/Vsec).

This toner was tested using the printing procedure described above. The reflection optical density (ROD) was 0.82 at plating voltages greater than 525 volts. The printed image exhibited excellent electrostatic transfer properties with no flow pattern and background.

Toners are printed in an imaging system as described in 2003/0044202 at paragraphs 19–28 to evaluate image qualities on paper (such as optical density ("OD"), flow pattern, background, etc.), and transfer efficiencies (T0, T1, and T2). Ink solids are measured on the ITB. In the process, Scotch tape was used to pick ink particles from various surfaces, such as OPC and ITB, and the taped images were placed on the blank paper to measure the ODs.

T0, T1 and T2 are defined as follows:

T0: inks are being transferred from developer roll to OPC

T1: inks are being transferred from OPC to ITB

T2: inks are being transferred from ITB to paper"

TABLE V

| Image Development and Transfer Characteristics of Acid/Base Gel Organosol Inks | | | | |
|---|---|---|---|---|
| | Example 33 | Example 34 | Example 32 | Example 35 |
| T0 (tape) | 1.458 OD | 1.666 OD | 1.660 OD | .981 OD |
| T1(−1.5 KV) (tape) | 88.8% remained OD 0.183 | 98.7% remained OD 0.022 | 99.5% remained OD 0.008 | 87.7% remained OD 0.138 |
| T2 (−2.5 KV) | 86.8% | 86.3% | 93.5% | 97.5% |
| T2 (−3.0 KV) | 86.4% | 86.9% | 92.8% | 98.8% |
| T2 (−3.5 KV) | 81.6% | 89.6% | 97.5% | 99.4% |
| T2 (−4.0 KV) | 68.8% | 88.0% | 96.0% | 94.9% |
| Paper OD @ −3.0 KV | 1.071 | 1.121 | 1.234 | .842 |
| ITB Ink % Solids | 33.8%. | 35.2% | 33.4% | 27.7% |

Tested at 23° C. & 55% relative humidity
All Dev bias: 550/750 V

As shown in the table, excellent image transfer was observed in compositions of the present invention using an electrostatic image transfer process.

Other embodiments of this invention will be apparent to those skilled in the art upon consideration of this specification or from practice of the invention disclosed herein. All patents, patent documents, and publications cited herein are incorporated by reference as if individually incorporated. Various omissions, modifications, and changes to the principles and embodiments described herein can be made by one skilled in the art without departing from the true scope and spirit of the invention which is indicated by the following claims.

The invention claimed is:

1. A liquid electrophotographic toner composition comprising:

a) a liquid carrier having a Kauri-butanol number less than 30 mL; and b) a plurality of toner particles dispersed in the liquid carrier, wherein the toner particles comprise polymeric binder comprising at least one amphipathic copolymer comprising one or more S material portions and one or more D material portions, wherein the S material portions and the D material portions have respective solubilities in the liquid carrier that are sufficiently different from each other such that the S material portions tend to be more solvated by the liquid carrier while the D material portions tend to be more dispersed in the liquid carrier, and wherein the toner composition comprises acidic and basic functionality in an amount sufficient to provide a three dimensional gel of controlled rigidity which can be reversibly reduced to a fluid state by application of energy; and wherein the electrophotographic toner composition does not form a film under Photoreceptor Image Formation conditions.

2. The liquid electrophotographic toner composition according to claim 1, wherein the acidic functionalities and basic are provided on one amphipathic copolymer.

3. The liquid electrophotographic toner composition according to claim 2, wherein one of the acidic or basic functionalities are located in the S material portion, and the corresponding acidic or basic functionalities needed to form the acid/base pair is located in the D material portion.

4. The liquid electrophotographic toner composition according to claim 3, wherein the acidic functionalities are located in the S material portion, and basic functionalities are located in the D material portion.

5. The liquid electrophotographic toner composition according to claim 3, wherein the basic functionalities are located in the S material portion, and acidic functionalities are located in the D material portion.

6. The liquid electrophotographic toner composition according to claim 1, wherein one of the acidic or basic functionalities are located on a first amphipathic copolymer, and the corresponding acidic or basic functionalities needed to form the acid/base pair is located on a second amphipathic copolymer.

7. The liquid electrophotographic toner composition according to claim 6, wherein the acidic or basic functionalities located on the first amphipathic copolymer are located on the S material portion of the first copolymer, and the acidic or basic functionalities located on the second amphipathic copolymer are located on the S material portion of the second copolymer.

8. The liquid electrophotographic toner composition according to claim 6, wherein the acidic or basic functionalities located on the first amphipathic copolymer are located on the D material portion of the first copolymer, and the acidic or basic functionalities located on the second amphipathic copolymer are located on the D material portion of the second copolymer.

9. The liquid electrophotographic toner composition according to claim 6, wherein the acidic or basic functionalities located on the first amphipathic copolymer are located on the S material portion of the first copolymer, and the acidic or basic functionalities located on the second amphipathic copolymer are located on the D material portion of the second copolymer.

10. The liquid electrophotographic toner composition according to claim 6, wherein the acidic or basic functionalities located on the first amphipathic copolymer are located on both the S material portion and the D material portion of the first copolymer, and the acidic or basic functionalities located on the second amphipathic copolymer are located on both the S material portion and the D material portion of the second copolymer.

11. The liquid electrophotographic toner composition according to claim 1, said composition comprising a polyfunctional bridging compound having at least two acidic or basic functionalities to assist in gel formation.

12. The liquid electrophotographic toner composition according to claim 1, wherein one of the acidic or basic functionalities are located on an amphipathic copolymer, and the corresponding acidic or basic functionalities needed to form the acid/base pair is located on a polyfunctional bridging compound.

13. The liquid electrophotographic toner composition according to claim 12, wherein acidic functionalities are located on the amphipathic copolymer, and at least two basic functionalities are located on a polyfunctional bridging compound.

14. The liquid electrophotographic toner composition according to claim 12, wherein basic functionalities are located on the amphipathic copolymer, and at least two acidic functionalities are located on a polyfunctional bridging compound.

15. The liquid electrophotographic toner composition according to claim 1, wherein acidic functionalities are provided by incorporation of one or more acid-functional polymerizable compounds in the amphipathic copolymer, wherein the acid-functional polymerizable compound is selected from the group consisting of acrylic acid, 2-acrylamido-2-methyl propane sulfonic acid, crotonic acid, itaconic acid, maleic acid, methacrylic acid, pentaerythritol dimethacrylate, 2-carboxyethyl acrylate, styrene sulfonic acid, and 4-vinyl benzoic acid.

16. The liquid electrophotographic toner composition according to claim 1, wherein basic functionalities are provided by incorporation of one or more base-functional polymerizable compounds in the amphipathic copolymer, wherein the base-functional polymerizable compound is selected from the group consisting of 2-(dimethylamino) ethyl methylate, diacetone acrylamide, acrylamide, allyl alcohol, allyl amine, allyl diethylamine, allyl ethylamine, allyl dimethylamine, allyl hydroxyethyl ether, N-allyl piperidine, p-amino styrene, diallyl amine, bis-diallylamino methane, t-butylamino methacrylate, diethylaminoethyl methacrylate, diallyl methylamine, N,N-diallylmelamine, 2-dimethylaminoethyl methacrylate, dimethylaminopropyl acrylamide, 2-dimethylamino methyl styrene, 3-dimethylamino neopentyl acrylate, 2,3-dihydroxy propyl acrylate, 2-diisopropylaminoethyl methacrylate, 4-hydroxybutyl acrylate, 4-hydroxybutyl methacrylate, 2-hydroxyethyl acrylate, 2-hydroxyethyl methacrylate, 2-hydroxypropyl acrylate, 2-hydroxypropyl methacrylate, 4-hydroxy styrene, vinyl benzene alcohol, vinyl benzene dimethylamine, 2-vinyl pyridine, 4-vinyl pyridine, and N-vinyl-2-pyrrolidone.

17. The liquid electrophotographic toner composition according to claim 1, wherein the D material portion of the amphipathic copolymer has a total calculated $T_g$ greater than or equal to about 30° C.

18. The liquid electrophotographic toner composition according to claim 1, wherein the D material portion of the amphipathic copolymer has a total calculated $T_g$ of from about 50–60° C.

19. The liquid electrophotographic toner composition according to claim 1, wherein the amphipathic copolymer has a total calculated $T_g$ greater than or equal to about 30° C.

20. The liquid electrophotographic toner composition according to claim 1, wherein the amphipathic copolymer has a total calculated $T_g$ greater than about 55° C.

21. The liquid electrophotographic toner composition according to claim 1, the toner particle comprising at least one visual enhancement additive.

22. A method of making a liquid electrophotographic toner composition, comprising the steps of:

a) providing a plurality of free radically polymerizable monomers, wherein at least one of the monomers comprises a first reactive functionality;

b) free radically polymerizing the monomers in a solvent to form a first reactive functional polymer, wherein the monomers and the first reactive functional polymer are soluble in the solvent;

c) reacting a compound having a second reactive functionality that is reactive with the first reactive functionality and free radically polymerizable functionality with the first reactive functional polymer under conditions such that at least a portion of the second reactive functionality of the compound reacts with at least a portion of the first reactive functionality of the polymer to form one or more linkages by which the compound is linked to the polymer, thereby providing an S material portion polymer with pendant free radically polymerizable functionality;

d) copolymerizing ingredients comprising (i) the S material portion polymer with pendant free radically polymerizable functionality, (ii) one or more free radically polymerizable monomers, and (iii) a liquid carrier in which polymeric material derived from ingredients comprising the one or more additional monomers of ingredient (ii) is insoluble;

said copolymerizing occurring under conditions effective to form an amphipathic copolymer having S and D portions and to incorporate acidic or basic functionality in the copolymer, wherein the S material portions and the D material portions have respective solubilities in the liquid carrier that are sufficiently different from each other such that the S material portions tend to be more solvated by the liquid carrier while the D material portions tend to be more dispersed in the liquid carrier; wherein the toner composition comprises acidic and basic functionality in an amount sufficient to provide a three dimensional gel of controlled rigidity which can be reversibly reduced to a fluid state by application of energy; and wherein the electrophotographic toner composition does not form a film under Photoreceptor Image Formation conditions.

23. A method of electrophotographically forming an image on a substrate surface comprising steps of:

a) providing a liquid toner composition of claim 1;

b) causing an image comprising the toner particles in a carrier liquid to be formed on a surface of a photoreceptor; and c) transferring the image from the surface of the photoconductor to an intermediate transfer material or directly to a print medium without film formation on the photoreceptor.

24. The method of claim 22, wherein the first reactive functionality is selected from hydroxyl and amine functionalities, and the second reactive functionality is selected from isocyanate and epoxy functionalities.

25. The method of claim 22, wherein the first reactive functionality is a hydroxyl functionality, and the second reactive functionality is an isocyanate functionality.

26. The method of claim 22, wherein the first reactive functionality is selected from isocyanate and epoxy functionalities, and the second reactive functionality is selected from hydroxyl and amine functionalities.

* * * * *